US010000829B2

(12) United States Patent
Toda et al.

(10) Patent No.: US 10,000,829 B2
(45) Date of Patent: Jun. 19, 2018

(54) HOT-ROLLED STEEL SHEET

(71) Applicant: NIPPON STEEL & SUMITOMO METAL CORPORATION, Chiyoda-ku, Tokyo (JP)

(72) Inventors: Yuri Toda, Tokyo (JP); Masafumi Azuma, Tokyo (JP); Akihiro Uenishi, Tokyo (JP); Genichi Shigesato, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 143 days.

(21) Appl. No.: 14/774,249

(22) PCT Filed: Apr. 14, 2014

(86) PCT No.: PCT/JP2014/060644

§ 371 (c)(1),
(2) Date: Sep. 10, 2015

(87) PCT Pub. No.: WO2014/171427

PCT Pub. Date: Oct. 23, 2014

(65) Prior Publication Data

US 2016/0017465 A1 Jan. 21, 2016

(30) Foreign Application Priority Data

Apr. 15, 2013 (JP) ..... 2013-085009

(51) Int. Cl.
*C22C 38/32* (2006.01)
*C21D 9/46* (2006.01)
(Continued)

(52) U.S. Cl.
CPC ..... *C22C 38/32* (2013.01); *C21D 8/0263* (2013.01); *C21D 9/46* (2013.01); *C22C 38/00* (2013.01);
(Continued)

(58) Field of Classification Search
CPC ..... C21D 2211/002; C21D 2211/005; C21D 8/0263; C21D 9/46; C22C 38/00
(Continued)

(56) References Cited

U.S. PATENT DOCUMENTS 6,251,198 B1 6/2001 Koo et al.
6,254,698 B1 7/2001 Koo et al.
(Continued)

FOREIGN PATENT DOCUMENTS

CN 102791896 B 6/2014
JP 2002-534601 A 10/2002
(Continued)

OTHER PUBLICATIONS

NPL: English Machnie translation of JP 2011241456A, Dec. 2011.*
(Continued)

*Primary Examiner* — Jie Yang
(74) *Attorney, Agent, or Firm* — Birch, Stewart, Kolasch & Birch, LLP

(57) ABSTRACT

A hot-rolled steel sheet includes a specified chemical composition and includes a steel structure represented by an area ratio of ferrite being 5% to 50%, an area ratio of bainite composed of an aggregate of bainitic ferrite whose grain average misorientation is 0.4° to 3° being 50% to 90%, and a total area ratio of martensite, pearlite, and retained austenite being 5% or less.

4 Claims, 1 Drawing Sheet

(51) Int. Cl.

| | |
|---|---|
| ***C22C 38/00*** | (2006.01) |
| ***C22C 38/06*** | (2006.01) |
| ***C21D 8/02*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/22*** | (2006.01) |
| ***C22C 38/26*** | (2006.01) |
| ***C22C 38/28*** | (2006.01) |

(52) U.S. Cl.
CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/26* (2013.01); *C22C 38/28* (2013.01); *C21D 2211/002* (2013.01); *C21D 2211/005* (2013.01)

(58) Field of Classification Search
USPC ..... 420/83; 148/504, 320, 330
See application file for complete search history.

(56) References Cited

U.S. PATENT DOCUMENTS

| | | | |
|---|---|---|---|
| 2005/0150580 | A1 | 7/2005 | Akamizu et al. |
| 2006/0081312 | A1 | 4/2006 | Yokoi et al. |
| 2006/0266445 | A1 | 11/2006 | Yokoi et al. |
| 2009/0050243 | A1 | 2/2009 | Satou et al. |
| 2009/0092514 | A1 | 4/2009 | Asahi et al. |
| 2011/0297281 | A1 | 12/2011 | Satou et al. |
| 2012/0012231 | A1 | 1/2012 | Murakami et al. |
| 2012/0018028 | A1 | 1/2012 | Shimamura et al. |
| 2013/0000791 | A1 | 1/2013 | Takahashi et al. |
| 2013/0048159 | A1 | 2/2013 | Kim et al. |
| 2013/0087254 | A1 | 4/2013 | Funakawa et al. |
| 2013/0276940 | A1 | 10/2013 | Nakajima et al. |
| 2014/0000765 | A1 | 1/2014 | Nozaki et al. |
| 2014/0014236 | A1 | 1/2014 | Nozaki et al. |

FOREIGN PATENT DOCUMENTS

| | | | | |
|---|---|---|---|---|
| JP | 2004-218077 | A | | 8/2004 |
| JP | 2004-256906 | A | | 9/2004 |
| JP | 2005-82841 | A | | 3/2005 |
| JP | 2005-220440 | A | | 8/2005 |
| JP | 2006-274318 | A | | 10/2006 |
| JP | 2007-314828 | A | | 12/2007 |
| JP | 2008-202119 | A | | 9/2008 |
| JP | 2009-263752 | | | 11/2009 |
| JP | 2010-202976 | A | | 9/2010 |
| JP | 2010-255090 | A | | 11/2010 |
| JP | 2011-28022 | A | | 3/2011 |
| JP | 2011-225941 | A | | 11/2011 |
| JP | 2011241456 | A | * | 12/2011 |
| JP | 2012-26032 | A | | 2/2012 |
| JP | 2012-62561 | A | | 3/2012 |
| WO | WO 2012/133563 | A1 | | 10/2012 |

OTHER PUBLICATIONS

Extended European Search Report, dated Oct. 7, 2016, for European Application No. 14784913.7.
Korean Office Action, dated Oct. 21, 2016, for Korean Application No. 10-2015-7026274, along with an English machine translation.
International Search Report, issued in PCT/JP2014/060644, dated Jun. 24, 2014.
Kato et al., "Development of new hot-rolled high strength thin steel sheet", Seitetsukenkyu, 1984, vol. 312, pp. 40-51.
Office Action of Taiwanese Patent Application No. 103113701, dated Mar. 18, 2015.
Written Opinion of the International Searching Authority, issued in PCT/JP2014/060644, dated Jun. 24, 2014.
Office Action of Chinese Patent Application No. 201480019121.9, dated May 16, 2016.
English translation of the International Preliminary Report on Patentabiity and Written Opinion of the International Searching Authority (Forms PCT/IB/338, PCT/IB/373 and PCT/ISA/237), dated Oct. 29, 2015, for International Application No. PCT/JP2014/060644.
European Office Action, dated Feb. 20, 2018, for European Application No. 14784913.7.

* cited by examiner

HOT-ROLLED STEEL SHEET

TECHNICAL FIELD

The present invention relates to a hot-rolled steel sheet excellent in an elongation and a hole expandability.

BACKGROUND ART

Weight reduction of a body of an automobile using a high-strength steel sheet has been put forward, in order to suppress an emission amount of carbon dioxide gas from an automobile. A high-strength steel sheet has come to be often used for a body in order also to secure safety of a passenger. Further improvement of strength is important to further proceed with weight reduction of a body. On the other hand, some parts of a body require excellent formability. For example, an excellent hole expandability is required for a high-strength steel sheet for an underbody part.

However, attaining both of a strength improvement and a formability improvement is difficult. In general, the higher a strength of a steel sheet is, the lower a formability is, and an elongation, which is important in drawing and bulging, and a hole expandability, which is important in burring, are reduced.

Patent Literatures 1 to 11 describe high-strength steel sheets intended to improve formability or something. However, a hot-rolled steel sheet having a sufficient strength and a sufficient formability cannot be obtained by the conventional techniques.

Though a technique related to improvement of a hole expandability is described in Non Patent Literature 1, a hot-rolled steel sheet having a sufficient strength and a sufficient formability cannot be obtained by this conventional technique. Further, this conventional technique is hard to be applied to a manufacturing process on an industrial scale of a hot-rolled steel sheet.

CITATION LIST

Patent Literature

Patent Literature 1: Japanese Laid-open Patent Publication No. 2012-26032

Patent Literature 2: Japanese Laid-open Patent Publication No. 2011-225941

Patent Literature 3: Japanese Laid-open Patent Publication No. 2006-274318

Patent Literature 4: Japanese Laid-open Patent Publication No. 2005-220440

Patent Literature 5: Japanese Laid-open Patent Publication No. 2010-255090

Patent Literature 6: Japanese Laid-open Patent Publication No. 2010-202976

Patent Literature 7: Japanese Laid-open Patent Publication No. 2012-62561

Patent Literature 8: Japanese Laid-open Patent Publication No. 2004-218077

Patent Literature 9: Japanese Laid-open Patent Publication No. 2005-82841

Patent Literature 10: Japanese Laid-open Patent Publication No. 2007-314828

Patent Literature 11: Japanese Laid-open Patent Publication No. 2002-534601

Non Patent Literature

Non Patent Literature 1: Kato et al., Seitetsukenkyu (1984) vol. 312, p. 41

SUMMARY OF INVENTION

Technical Problem

A purpose of the present invention is to provide a hot-rolled steel sheet having a high strength and capable of obtaining excellent elongation and hole expandability.

Solution to Problem

The inventors of the present application, with an eye on a general manufacturing method of a hot-rolled steel sheet implemented in an industrial scale using a common continuous hot-rolling mill, have conducted keen studies in order to improve a formability such as an elongation and a hole expandability of the hot-rolled steel sheet while obtaining a high strength. As a result, a new structure quite effective in securing the high strength and improving the formability has been found out, the structure not having been formed by a conventional technique. This structure is bainite composed of an aggregate of bainitic ferrite whose grain average misorientation is 0.4° or more to 3° or less. This bainite hardly contains carbide and retained austenite in a grain. In other words, this bainite hardly contains what promotes development of a crack in hole expanding. Thus, this bainite contributes to securing of the high strength and improvement of the elongation and the hole expandability.

The bainite composed of the aggregate of bainitic ferrite whose grain average misorientation is 0.4° or more to 3° or less is not able to be formed by a conventional method such as methods described in above-described Patent Literatures 1 to 11. For example, the above bainite cannot be formed by a conventional technique intended to heighten a strength by forming martensite through making a cooling rate higher from the end of so called intermediate air cooling to coiling. For example, bainite included in a conventional steel sheet is composed of bainitic ferrite and an iron carbide, or composed of bainitic ferrite and retained austenite. Thus, in the conventional steel sheet, the iron carbide or retained austenite (or martensite having been transformed by being processed) promotes development of a crack in hole expanding. Accordingly, the bainite composed of the aggregate of bainitic ferrite whose grain average misorientation is 0.4° or more to 3° or less has a hole expandability superior to bainite included in a conventional steel sheet. This bainite is a structure different also from ferrite included in a conventional steel sheet. For example, a generating temperature of this bainite is equal to or lower than a bainite transformation start temperature estimated from a component of steel, and a grain boundary with a low angle exists inside a grain surrounded by a high-angle grain boundary of this bainite. This bainite has a feature different from that of ferrite at least in the above points.

With details being described later, the inventors of the present application have found that by making conditions of finish rolling, cooling thereafter, coiling thereafter, cooling thereafter, and something be appropriate, the bainite can be formed with a desired area ratio together with ferrite. By methods described in Patent Literatures 1 to 3, it is impossible to form bainite having a grain boundary with a low angle inside a grain surrounded by a high-angle grain boundary, since a cooling rate after the end of intermediate air cooling and before coiling, and a cooling rate in a state of coil are quite high.

The inventors of the present application have further conducted keen studies based on the above observation, and have conceived embodiments of the invention described below.

(1) A hot-rolled steel sheet including:

a chemical composition represented by, in mass %,

C: 0.02% to 0.15%,

Si: 0.01% to 2.0%,

Mn: 0.05% to 3.0%,

P: 0.1% or less,

S: 0.03% or less,

Al: 0.001% to 0.01%,

N: 0.02% or less,

O: 0.02% or less,

Ti: 0% to 0.2%,

Nb: 0% to 0.2%

Mo: 0% to 0.2%

V: 0% to 0.2%

Cr: 0% to 1.0%,

B: 0% to 0.01%,

Cu: 0% to 1.2%,

Ni: 0% to 0.6%,

Ca: 0% to 0.005%,

REM: 0% to 0.02%, and the balance: Fe and an impurity; and a steel structure represented by an area ratio of ferrite: 5% to 50%, an area ratio of bainite composed of an aggregate of bainitic ferrite whose grain average misorientation is 0.4° to 3°:50% to 95%, and a total area ratio of martensite, pearlite, and retained austenite: 5% or less.

(2) The hot-rolled steel sheet according to (1), wherein the chemical composition satisfies one or more selected from the group consisting of, in mass %, Ti: 0.01% to 0.2%, Nb: 0.01% to 0.2%, Mo: 0.001% to 0.2%, V: 0.01% to 0.2%, Cr: 0.01% to 1.0%, B: 0.0002% to 0.01%, Cu: 0.02% to 1.2%, and Ni: 0.01% to 0.6%.

(3) The hot-rolled steel sheet according to (1) or (2), wherein the chemical composition satisfies one or more selected from the group consisting of, in mass %, Ca: 0.0005% to 0.005% and REM: 0.0005% to 0.02%.

Advantageous Effects of Invention

According to the present invention, it is possible to obtain excellent elongation and hole expandability while having a high strength.

DESCRIPTION OF EMBODIMENTS

Hereinafter, an embodiment of the present invention will be described.

Figure 1:
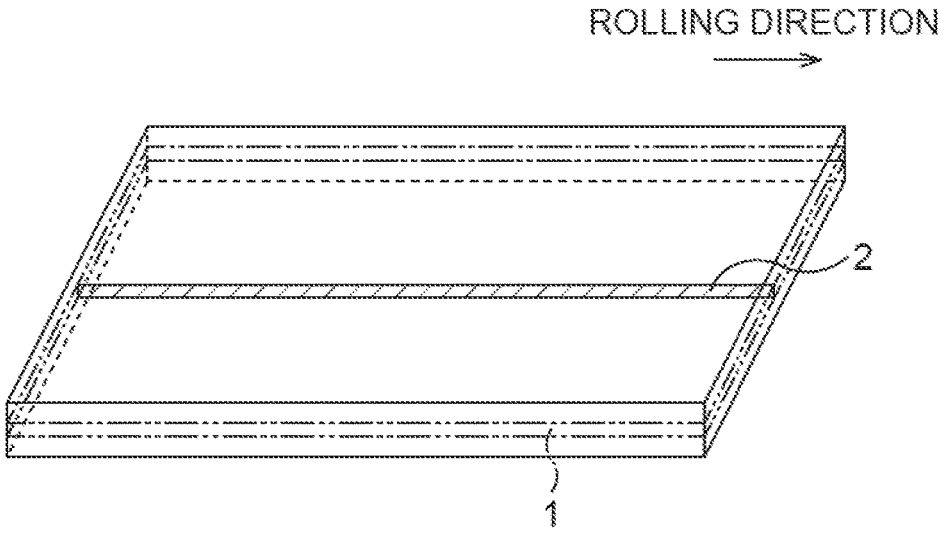
FIG. 1 is a view illustrating a region representing a steel structure of a hot-rolled steel sheet.

First, a steel structure of a hot-rolled steel sheet according to the present embodiment will be described. The hot-rolled steel sheet according to the present embodiment includes a steel structure represented by an area ratio of ferrite: 5% to 50%, an area ratio of bainite composed of an aggregate of bainitic ferrite whose grain average misorientation is 0.4° to 3°:50% to 95%, a total area ratio of martensite, pearlite, and retained austenite: 5% or less. The steel structure of the hot-rolled steel sheet may be represented by a steel structure in a region between ⅜ and ⅝ of a thickness of the hot-rolled steel sheet from a surface thereof. This region 1 is illustrated in FIG. 1. A cross section 2 being an object of steel structure observation is also illustrated in FIG. 1.

(Area Ratio of Ferrite: 5% to 50%)

Ferrite exhibits an excellent ductility and heightens a uniform elongation. When the area ratio of ferrite is less than 5%, a good uniform elongation cannot be obtained. Therefore, the area ratio of ferrite is 5% or more. When the area ratio of ferrite is over 50%, a hole expandability is considerably reduced. Thus, the area ratio of ferrite is 50% or less. The area ratio of ferrite is an area ratio in the cross section 2 parallel to a rolling direction in the region between ⅜ and ⅝ the thickness of the hot-rolled steel sheet from the surface thereof, and is an area ratio of ferrite in a microstructure observed at a magnification of 200 times to 500 times using an optical microscope.

(Area Ratio of Bainite Composed of Aggregate of Bainitic Ferrite Whose Grain Average Misorientation is 0.4° to 3°:50% to 95%)

Bainite composed of the aggregate of bainitic ferrite whose grain average misorientation is 0.4° or more to 3° or less is a new structure obtained by a later-described method. The grain average misorientation in a grain is obtained as below. First, crystal orientations of some points in the cross section 2 are measured by an electron back scattering diffraction (EBSD) method. Then, based on the measurement results by EBSD, it is assumed that a grain boundary exists between two points (pixels) which are adjacent to each other and between which a crystal misorientation is 15° or more. Then, within a region surrounded by the grain boundary, that is, within the grain, crystal misorientations between points adjacent to each other are calculated, and an average value thereof is calculated. The grain average misorientation within a crystal grain is obtained in this way.

As described above, it is found by inventors of the present application that bainite composed of the aggregate of bainitic ferrite whose grain average misorientation is 0.4° or more to 3° or less is a structure quite effective for securing of a high strength and improvement of a formability such as a hole expandability. This bainite hardly contains carbide and retained austenite in the grain. In other words, this bainite hardly contains what promotes development of a crack in hole expanding. Therefore, this bainite contributes to securing of the high strength and improvement of the elongation and the hole expandability.

When the area ratio of bainite composed of the aggregate of bainitic ferrite whose grain average misorientation is 0.4° or more to 3° or less is less than 50%, a sufficient strength cannot be obtained. Therefore, the area ratio of this bainite is 50% or more. When the area ratio of this bainite is over 95%, a sufficient elongation cannot be obtained. Therefore, the area ratio of this bainite is 95% or less. When the area ratio of this bainite is 50% or more to 95% or less, generally, a tensile strength is 590 MPa or more, a product (TS×λ) of the tensile strength (TS (MPa)) and a hole expansion ratio (λ(%)) is 65000 or more, and a product (EL×λ) of a total elongation (EL (%)) and the hole expansion ratio (λ(%)) is 1300 or more. These characteristics are suitable for a processing of an underbody part of an automobile.

A grain whose grain average misorientation is less than 0.4° may be regarded as ferrite. A grain whose grain average misorientation is over 3° is inferior in the hole expandability. The grain whose grain average misorientation is over 3° is generated in a lower temperature zone than the bainite composed of the aggregate of bainitic ferrite whose grain average misorientation is 0.4° or more to 3° or less, for example.

(Total Area Ratio of Martensite, Pearlite, and Retained Austenite: 5% or Less)

Martensite, pearlite, and retained austenite promote development of a crack at an interface with ferrite or bainite in hole expanding, and reduces the hole expandability. When the total area ratio of martensite, pearlite, and retained austenite is over 5%, such deterioration of the hole expandability is prominent. The area ratios of pearlite, martensite, and retained austenite are each area ratios in the cross section 2 and area ratios of perlite, martensite, and retained austenite in a microstructure observed at the magnification of 200 times to 500 times using the optical microscope. When a total of these structures is 5% or less, generally, the product (EL×λ) of the total elongation (EL (%)) and the hole expansion ratio (λ(%)) is over 1300, and suitable for a processing of the underbody part of the automobile.

It is a matter of course that a condition related to the aforementioned area ratio of each structure is preferable to be satisfied not only in the region 1 but also in a broader range, and the broader the range where this condition is satisfied is, the more excellent strength and workability can be obtained.

Next, a chemical composition of the hot-rolled steel sheet according to the embodiment of the present invention will be described. In description hereinafter, "%" being a unit of a content of each element contained in the hot-rolled steel sheet means "mass %" unless mentioned otherwise. The hot-rolled steel sheet according to the present embodiment includes a chemical composition represented by C: 0.02% to 0.15%, Si: 0.01% to 2.0%, Mn: 0.05% to 3.0%, P: 0.1% or less, S: 0.03% or less, Al: 0.001% to 0.01%, N: 0.02% or less, O: 0.02% or less, Ti: 0% to 0.2%, Nb: 0% to 0.2%, Mo: 0% to 0.2%, V: 0% to 0.2%, Cr: 0% to 1.0%, B: 0% to 0.01%, Cu: 0% to 1.2%, Ni: 0% to 0.6%, Ca: 0% to 0.005%, REM: 0% to 0.02%, and the balance: Fe and an impurity. As the impurity, there are exemplified what is included in a raw material such as ore and scrap and what is included in a manufacturing process.

(C: 0.02% to 0.15%)

C segregates in a grain boundary and has an effect to suppress peeling on an end surface formed by shearing or punch-cutting. C couples with Nb, Ti, or the like and forms a precipitate in the hot-rolled steel sheet, contributing to improvement of the strength by precipitation strengthening. When a C content is less than 0.02%, the effect to suppress peeling and an effect to improve the strength by precipitation strengthening cannot be obtained sufficiently. Therefore, the C content is 0.02% or more. On the other hand, C generates an iron-based carbide such as cementite ($Fe_3C$), martensite, and retained austenite to be a starting point of a fracture in hole expanding. When the C content is over 0.15%, the sufficient hole expandability cannot be obtained. Therefore, the C content is 0.15% or less.

(Si: 0.01% to 2.0%)

Si contributes to improvement of the strength of the hot-rolled steel sheet. Si also has a role as a deoxidizing material of molten steel. Si suppresses precipitation of an iron-based carbide such as cementite and suppresses precipitation of cementite in a boundary of bainitic ferrite. When an Si content is less than 0.01%, above effects cannot be obtained sufficiently. Therefore, the Si content is 0.01% or more. When the Si content is over 2.0%, the effect to suppress precipitation of cementite is saturated. Further, when the Si content is over 2.0%, generation of ferrite is suppressed, so that a desired steel structure in which the area ratio of ferrite is 5% or more cannot be obtained. Therefore, the Si content is 2.0% or less.

(Mn: 0.05% to 3.0%)

Mn contributes to improvement of the strength by solid solution strengthening. When a Mn content is less than 0.05%, the sufficient strength cannot be obtained. Therefore, the Mn content is 0.05% or more. When the Mn content is over 3.0%, a slab fracture occurs. Therefore, the Mn content is 3.0% or less.

(P: 0.1% or Less)

P is not an essential element and is contained as an impurity in steel, for example. In view of a workability, a weldability, and a fatigue characteristic, a P content as low as possible is preferable. In particular, when the P content is over 0.1%, deterioration of the workability, the weldability, and the fatigue characteristic is prominent. Therefore, the P content is 0.1% or less.

(S: 0.03% or Less)

S is not an essential element and is contained as an impurity in steel, for example. A higher S content makes it easier for an A-based inclusion leading to deterioration of the hole expandability to be generated, and thus, the S content as low as possible is preferable. In particular, when the S content is over 0.03%, deterioration of the hole expandability is prominent. Therefore, the S content is 0.03% or less.

(Al: 0.001% to 0.01%)

Al has an action to deoxidize molten steel. When an Al content is less than 0.001%, sufficient deoxidation is difficult. Therefore, the Al content is 0.001% or more. When the Al content is over 0.01%, the elongation is easy to be reduced due to increase of non-metal inclusions. Therefore, the Al content is 0.01% or less.

(N: 0.02% or Less)

N is not an essential element and is contained as an impurity in steel, for example. In view of the workability, an N content as low as possible is preferable. In particular, when the N content is over 0.02%, deterioration of the workability is prominent. Therefore, the N content is 0.02% or less.

(O: 0.02% or Less)

O is not an essential element and is contained as an impurity in steel, for example. In view of the workability, an O content as low as possible is preferable. In particular, when the O content is over 0.02%, deterioration of the workability is prominent. Therefore, the 0 content is 0.02% or less.

Ti, Nb, Mo, V, Cr, B, Cu, Ni, Ca, and REM are not essential elements but arbitrary elements, which may be properly contained in the hot-rolled steel sheet to limits of predetermined contents.

(Ti: 0% to 0.2%, Nb: 0% to 0.2%, Mo: 0% to 0.2%, V: 0% to 0.2%, Cr: 0% to 1.0%, B: 0% to 0.01%, Cu: 0% to 1.2%, Ni: 0% to 0.6%)

Ti, Nb, Mo, V, Cr, B, Cu, and Ni contribute to further improvement of the strength of the hot-rolled steel sheet by precipitation hardening or solid solution strengthening. Therefore, one or more kinds selected from the group consisting of these elements may be contained. However, with regard to Ti, Nb, Mo, and V, when a content of any one thereof is over 0.2%, generation of ferrite is suppressed, so that the desired steel structure in which the area ratio of ferrite is 5% or more cannot be obtained. Therefore, a Ti content, an Nb content, an Mo content, and a V content are each 0.2% or less. When a Cr content is over 1.0%, an effect to improve the strength is saturated. Further, when the Cr content is over 1.0%, generation of ferrite is suppressed, so that the desired steel structure in which the area ratio of ferrite is 5% or more cannot be obtained. Therefore, the Cr content is 1.0% or less. When a B content is over 0.01%, generation of ferrite is suppressed, so that the desired steel structure in which the area ratio of ferrite is 5% or more cannot be obtained. Therefore, the B content is 0.01% or less. When a Cu content is over 1.2%, generation of ferrite is suppressed, so that the desired steel structure in which the area ratio of ferrite is 5% or more cannot be obtained. Therefore, the Cu content is 1.2% or less. When an Ni content is over 0.6%, generation of ferrite is suppressed, so that the desired steel structure in which the area ratio of ferrite is 5% or more cannot be obtained. Therefore, the Ni content is 0.6% or less. In order to secure a more excellent strength of the hot-rolled steel sheet, the Ti content, the Nb content, the V content, the Cr content, and the Ni content are each preferably 0.01% or more, the Mo content is preferably 0.001% or more, the B content is preferably 0.0002%, and the Cu content is preferably 0.02% or more. In other words, it is preferable that at least one of "Ti: 0.01% to 0.2%", "Nb: 0.01% to 0.2%", "Mo: 0.001% to 0.2%", "V: 0.01% to 0.2%", "Cr: 0.01% to 1.0%", "B: 0.0002% to 0.01%", "Cu: 0.02% to 1.2%", and "Ni: 0.01% to 0.6%" is satisfied.

(Ca: 0% to 0.005%, REM: 0% to 0.02%)

Ca and REM change a form of a non-metal inclusion which may be a starting point of destruction or deteriorate the workability, and make the non-metal inclusion harmless. Therefore, one or more kinds selected from the group consisting of the above elements may be contained. However, when a Ca content is over 0.005%, the form of the non-metal inclusion is elongated, and the non-metal inclusion may be the starting point of destruction or deteriorate the workability. When a REM content is over 0.02%, the form of the non-metal inclusion is elongated and the non-metal inclusion may be the starting point of destruction or deteriorate the workability. Therefore, the Ca content is 0.005% or less and the REM content is 0.02% or less. In order to make an effect of making the non-metal inclusion harmless more excellent, the Ca content and the REM content are each preferable 0.0005% or more. In other words, it is preferable that at least one of "Ca: 0.0005% to 0.005%" and "REM: 0.0005% to 0.02%" is satisfied.

REM (rare earth metal) indicates elements of 17 kinds in total of Sc, Y, and lanthanoid, and the "REM content" means a content of a total of these 17 kinds of elements. Lanthanoid is industrially added in a form of misch metal, for example.

Next, an example of a method for manufacturing the hot-rolled steel sheet according to the present embodiment will be described. Though the hot-rolled steel sheet according to the present embodiment can be manufactured by the method described here, a method for manufacturing the hot-rolled steel sheet according to the present embodiment is not limited thereto. In other words, even if a hot-rolled steel sheet is manufactured by another method, as long as the hot-rolled steel sheet includes the above-described steel structure and chemical composition, the hot-rolled steel structure can be regarded as being within the scope of the embodiment. For example, though a hot-rolling facility of seven passes is used in the following method, a hot-rolled steel sheet manufactured using a hot-rolling facility of six passes may sometimes fall within the scope of the present embodiment.

Figure 2:
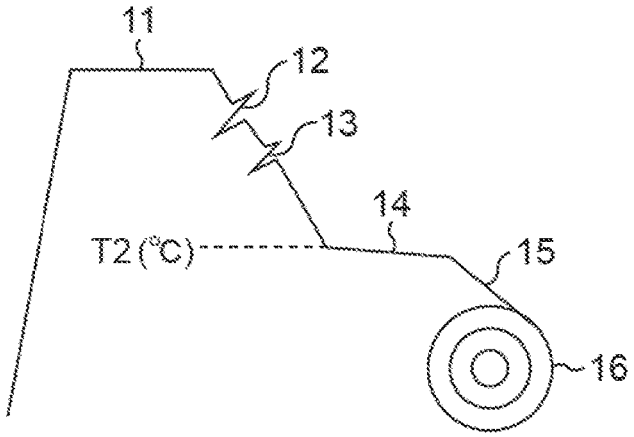
FIG. 2 is a view illustrating an outline of a temperature history from hot rolling to coiling.

In this method, following steps are carried out in sequence. FIG. 2 illustrates an outline of a temperature history from hot rolling to coiling.

(1) A steel ingot or slab including the above-described chemical composition is casted, and reheating 11 is carried out as necessary.

(2) Rough rolling 12 of the steel ingot or slab is carried out. The rough rolling is included in the hot rolling.

(3) Finish rolling 13 of the steel ingot or slab is carried out. The finish rolling is included in the hot rolling. In the finish rolling, rolling of one pass before rolling of a final stage is carried out at a temperature of 850° C. or more to 1150° C. or less and at a reduction of 10% or more to 40% or less, and the rolling of the final stage is carried out at a temperature (T1(° C.)) of 850° C. or more to 1050° C. or less and at a reduction of 3% or more to 10% or less.

(4) Cooling is carried out on a run out table to a temperature (T2(° C.)) of 600° C. or more to 750° C. or less. A time from the end of the finish rolling to the start of the cooling is indicated as t1 (second).

(5) Air cooling 14 for a time (t2 (second)) of 1 second or more to 10 seconds or less is carried out. During this air cooling, ferrite transformation in a two-phase region occurs, and an excellent elongation can be obtained.

(6) Cooling 15 at a cooling rate of P (° C./second) to a temperature of 400° C. or more to 650° C. or less is carried out. The cooling rate P satisfies (formula 1) below.

(7) Coiling 16 at the temperature of 400° C. or more to 650° C. or less is carried out.

(8) A hot-rolled coil is cooled at a cooling rate of 0.15° C./minute or less, while a temperature of the hot-rolled coil is T3(° C.)-300° C. or more to T3(° C.) or less. T3(° C.) is represented by (formula 2) below.

(9) Cooling is carried out from a temperature of less than T3(° C.)-300° C. to 25° C. at a cooling rate of 0.05° C./minute or less.

$$P(^\circ\,\mathrm{C./second}) \geq 1/\{1.44\times10^{12}\exp(-3211/(T1+273))\times t1^{1/3}\}\times2\times10^{11}+(\mathrm{C})\times1/\{1-(1.44\times10^{12}\exp(-3211/(T2+273))\times t2^{1/3}\}\times(-3)\times10^{13} \quad \text{(formula 1)}$$

$$T3(^\circ\,\mathrm{C.})=830-270\times(\mathrm{C})-90\times(\mathrm{Mn})-37\times(\mathrm{Ni})-70\times(\mathrm{Cr})-83\times(\mathrm{Mo}) \quad \text{(formula 2)}$$

Here, (C), (Mn), (Ni), (Cr), and (Mo) indicate a C content, an Mn content, an Ni content, a Cr content, and an Mo content of a hot-rolled steel sheet, respectively.

In casting of the steel ingot or slab, molten steel whose components are adjusted to have a chemical composition within a range described above is casted. Then, the steel ingot or slab is sent to a hot rolling mill. On this occasion, the casted steel ingot or slab having a high temperature may be directly sent to the hot rolling mill, or may be cooled to a room temperature and thereafter reheated in a heating furnace, and sent to the hot rolling mill. A temperature of reheating is not limited in particular. When the reheating temperature is 1260° C. or more, an amount of scaling off increases and sometimes reduces a yield, and thus the reheating temperature is preferably less than 1260° C. Further, when the reheating temperature is less than 1000° C., an operation efficiency is sometimes impaired significantly in terms of schedule, and thus the reheating temperature is preferably 1000° C. or more.

When a rolling temperature of the final stage of rough rolling is less than 1080° C., that is, when the rolling temperature is lowered to less than 1080° C. during rough rolling, an austenite grain after finish rolling becomes excessively small and transformation from austenite to ferrite is excessively promoted, so that desired bainite is sometimes hard to be obtained. Therefore, rolling of the final stage is preferably carried out at 1080° C. or more. When the rolling temperature of the final stage of rough rolling is over 1150° C., that is, when the rolling temperature exceeds 1150° C. during rough rolling, an austenite grain after finish rolling becomes large and ferrite transformation in a two-phase region to occur in later cooling is not sufficiently promoted, so that a desired steel structure is sometimes hard to be obtained. Therefore, rolling of the final stage is preferably carried out at 1150° C. or less.

When a cumulative reduction of the final stage and a previous stage thereof of rough rolling is over 65%, an austenite grain after finish rolling becomes excessively small, and transformation from austenite to ferrite is excessively promoted, so that desired bainite is sometimes hard to be obtained. Therefore, the cumulative reduction is preferably 65% or less. When the cumulative reduction is less than 40%, the austenite grain after finish rolling becomes large and ferrite transformation in the two-phase region to occur in later cooling is not sufficiently promoted, so that the desired steel structure is sometimes hard to be obtained. Therefore, the cumulative reduction is preferably 40% or more.

The finish rolling is important to generate bainite composed of an aggregate of bainitic ferrite whose grain average misorientation is 0.4° or more to 3° or less. The bainitic ferrite can be obtained as a result that austenite which includes a strain after being processed is transformed to bainite. Therefore, it is important to carry out finish rolling under a condition which makes a strain remain in austenite after finish rolling.

In the finish rolling, rolling of one pass before rolling of the final stage, the rolling of the final stage being rolling carried out in a final stand of a finish rolling mill, is carried out at a temperature of 850° C. or more to 1150° C. or less and at a reduction of 10% or more to 40% or less. When the rolling temperature of the above rolling is over 1150° C. or the reduction is less than 10%, an austenite grain after finish rolling becomes large and ferrite transformation in the two-phase region to occur in later cooling is not sufficiently promoted, so that the desired steel structure cannot be obtained. When the rolling temperature of the above rolling is less than 850° C. or the reduction is over 40%, the strain remains excessively in austenite after finish rolling, and the workability is deteriorated.

In the finish rolling, rolling of the final stage is carried out at a temperature of 850° C. or more to 1050° C. or less and at a reduction of 3% or more to 10% or less. The temperature (finish rolling end temperature) of rolling of the final stage is indicated as T1(° C.). When the temperature T1 is over 1050° C. or the reduction is less than 3%, a residual amount of the strain in austenite after finish rolling becomes insufficient, so that the desired steel structure cannot be obtained. When the temperature T1 is less than 850° C. or the reduction is over 10%, the strain remains excessively in austenite after finish rolling, so that the workability is deteriorated.

After the finish rolling, cooling is carried out on a run out table (ROT) to a temperature of 600° C. or more to 750° C. or less. A reaching temperature of the above cooling is indicated as T2(° C.). When the temperature T2 is less than 600° C., ferrite transformation in the two-phase region becomes insufficient, so that a sufficient elongation cannot be obtained. When the temperature T2 is over 750° C., ferrite transformation is excessively promoted, so that the desired steel structure cannot be obtained. An average cooling rate on the run out table is 20° C./second to 200° C./second, for example. This is for obtaining the desired steel structure stably.

Once the cooling on the run out table ends, air cooling for one second or more to ten seconds or less is carried out. A time of the air cooling is indicated as t2 (second). When the time t2 is less than one second, ferrite transformation in the two-phase region becomes insufficient, so that the sufficient elongation cannot be obtained. When the time t2 is over 10 seconds, ferrite transformation in the two-phase region is excessively promoted, so that the desired steel structure cannot be obtained.

A time from the end of finish rolling to the start of cooling on the run out table is indicated as t1 (second). The time t1 is not limited in particular, but is preferably 10 seconds or less in order to prevent coarsening of austenite after finish rolling. Air cooling is substantially carried out from the end of finish rolling to the start of cooling on the run out table.

Once the air cooling for the time t2 ends, cooling to a temperature of 400° C. or more to 650° C. or less at a predetermined cooling rate is carried out. The cooling rate is indicated as P(° C./second). The cooling rate P satisfies a relation of (formula 1). When the cooling rate P satisfies the relation of (formula 1), generation of pearlite in the air cooling can be suppressed, and area ratios of martensite, pearlite, and retained austenite can be made 5% or less in total. On the other hand, when the cooling rate P does not satisfy the relation of (formula 1), pearlite is generated in great amount, for example, so that the desired steel structure cannot be obtained. Therefore, the cooling rate P satisfying the relation of (formula 1) is quite important in order to obtain the desired steel structure.

The cooling rate P is preferably 200° C./second or less from a viewpoint of suppression of a warp due to a thermal strain and so on. The cooling rate P is more preferably 30° C./second or less from a viewpoint of further suppression of the warp and so on.

Thereafter, the coiling at a temperature of 400° C. or more to 650° C. or less is carried out. When the coiling temperature is over 650° C., ferrite is generated and sufficient bainite cannot be obtained, so that the desired steel structure cannot be obtained. When the coiling temperature is less than 400° C., martensite is generated and sufficient bainite cannot be obtained, so that the desired steel structure cannot be obtained.

While a temperature of a hot-rolled coil obtained by the coiling is T3(° C.)-300° C. or more to T3(° C.) or less, the hot-rolled coil is cooled at a cooling rate of 0.15° C./minute or less. When the cooling rate is 0.15° C./minute or less, bainite transformation can be promoted, and the area ratios of martensite, pearlite, and retained austenite can be made to be 5% or less in total. On the other hand, when the cooling rate is over 0.15° C./minute, bainite transformation is not sufficiently promoted and the area ratios of martensite, pearlite, and retained austenite exceed 5% in total, so that the workability is deteriorated. Therefore, the cooling rate being 0.15° C./minute or less is quite important in order to obtain the desired steel structure.

When the temperature of the hot-rolled coil exceeds the temperature T3(° C.), transformation from austenite to pearlite occurs, so that the desired steel structure cannot be obtained.

When the temperature of the hot-rolled coil is less than T3(° C.)-300° C., the hot-rolled coil is cooled at a cooling rate of 0.05° C./minute or less. When the cooling rate is 0.05° C./minute or less, transformation from untransformed austenite to martensite can be suppressed, so that a superior workability can be obtained. On the other hand, when the cooling rate is over 0.05° C./minute, transformation from austenite to martensite occurs, the area ratios of martensite, pearlite, and retained austenite exceed 5% in total, so that the workability is deteriorated. Further, during cooling, when the temperature of the hot-rolled coil rises to exceed T3(° C.)-300° C. due to heat generation concurrent with phase transformation from austenite to bainite, transformation from austenite to pearlite occurs and a structural fraction of pearlite exceeds 5%, so that the workability is deteriorated.

Even if the hot-rolled steel sheet according to the present embodiment is subjected to a surface treatment, effects to improve a strength, an elongation, and a hole expandability can be obtained. For example, electroplating, hot dipping, deposition plating, organic coating formation, film laminating, organic salts treatment, inorganic salts treatment, non-chroming treatment, or the like may be performed.

The above-described embodiment merely illustrates concrete examples of implementing the present invention, and the technical scope of the present invention is not to be construed in a restrictive manner by these embodiments. That is, the present invention may be implemented in various forms without departing from the technical spirit or main features thereof.

Examples

Next, an experiment the inventors of the present application carried out will be described. In this experiment, using a plurality of steels (steel symbols A to MMM) having chemical compositions listed in Table 1 and Table 2, samples of hot-rolled steel sheets having steel structures listed in Table 3 to Table 5 were manufactured, and their mechanical characteristics were investigated. The balance of each of the steels is Fe and an impurity. Further, an "area ratio of bainite" in Table 3 to Table 5 is an area ratio of bainite composed of an aggregate of bainitic ferrite whose grain average misorientation is 0.4° or more to 3° or less. A plating layer of the sample No. 29 is a hot-dip plating layer.

An area ratio of ferrite was specified by observing a cross section parallel to a rolling direction in a region between ⅜ and ⅝ of a thickness of the hot-rolled steel sheet from a surface at a magnification of 200 times to 500 times using an optical microscope. The area ratio of bainite composed of the aggregate of bainitic ferrite whose grain average misorientation is 0.4° or more to 3° or less was specified through measuring crystal directions of a plurality of points in the cross section parallel to the rolling direction in the region between ⅜ and ⅝ of the thickness of the hot-rolled steel sheet from the surface by the EBSD method. Each area ratio of pearlite, martensite, retained austenite was specified by observing the cross section parallel to the rolling direction in the region between ⅜ and ⅝ of the thickness of the hot-rolled steel sheet from the surface at the magnification of 200 times to 500 times using an optical microscope.

Then, a tensile test and a hole expansion test of each hot-rolled steel sheet were carried out. The tensile test was carried out using a No. 5 test piece, which is described in Japan Industrial Standard (JIS) Z 2201, fabricated from each hot-rolled steel sheet in accordance with a method described in Japan Industrial Standard (JIS) Z 2241. The hole expansion test was carried out in accordance with a method described in Japan Industrial Standard (JIS) Z 2256. Results of the above are also listed in Table 3 to Table 5.

As listed in Table 3 to Table 5, only in the samples within the scope of the present invention, the excellent elongation and hole expandability could be obtained while the high strength being obtained. In evaluation of the mechanical characteristic, it was targeted that a tensile strength was 590 MPa or more, that a product (TS×λ) of the tensile strength (TS (MPa)) and a hole expansion ratio (λ(%)) was 65000 or more, and that a product (EL×λ) of a total elongation (EL (%)) and the hole expansion ratio (λ(%)) was 1300 or more. In the sample No. 60, since the steel (steel symbol F) contained Mn excessively, a slab fracture occurred and a hot-rolled steel sheet was not able to be manufactured.

Each hot-rolled steel sheet was manufactured as below under a condition listed in Table 6 to Table 9. After smelting in a steel converter and continuous casting were carried out, reheating at a heating temperature listed in Table 3 to Table 6 was carried out, and hot-rolling including rough rolling and finish rolling of 7 passes was carried out. A temperature and a cumulative reduction of a final stage of the rough rolling are listed in Table 3 to Table 6. Further, a rolling end temperature and a reduction of the sixth pass, and a rolling end temperature (T1) and a reduction of the seventh pass (final stage) of the finish rolling are listed in Table 3 to Table 6. A thickness after hot rolling was 1.2 mm to 5.4 mm. After a time t1 (second) elapsed from the end of the finish rolling, cooling to a temperature T2 listed in Table 3 to Table 6 was carried out on a run out table. Then, once the temperature reached the temperature T2, air cooling was started. A time t2 of the air cooing is listed in Table 3 to Table 6. After the air cooling for the time t2, cooling was carried out to a coiling temperature listed in Table 3 to Table 6 at a cooling rate P (° C./second) listed in Table 3 to Table 6, and coiling was carried out at the coiling temperature, so that a hot-rolled coil was fabricated. Thereafter, cooling of two stages of first cooing and second cooling was carried out. The first cooling started at a starting temperature listed in Table 3 to Table 6, and ended at an end temperature listed in Table 3 to Table 6. A cooling rate during the first cooling is listed in Table 3 to Table 6. The second cooling started at a starting temperature listed in Table 3 to Table 6, and ended at 25° C. A cooling rate during the second cooling is listed in Table 3 to Table 6. Further, in manufacture of the hot-rolled steel sheet of the sample No. 29, hot dipping was performed after the second cooling ended.

TABLE 1

| STEEL SYMBOL | C | Si | Mn | P | S | Al | N | B | O | Ti |
|---|---|---|---|---|---|---|---|---|---|---|
| A | 0.041 | 0.954 | 1.250 | 0.007 | 0.001 | 0.0045 | 0.0036 | 0.0002 | 0.0032 | 0.123 |
| B | 0.008 | 0.855 | 1.260 | 0.007 | 0.001 | 0.0046 | 0.0038 | 0.0002 | 0.0030 | 0.125 |

TABLE 1-continued

| | | | | | | | | | | |
|---|---|---|---|---|---|---|---|---|---|---|
| C | 0.210 | 0.855 | 1.260 | 0.007 | 0.001 | 0.0046 | 0.0038 | 0.0002 | 0.0030 | 0.125 |
| D | 0.040 | 0.007 | 1.250 | 0.007 | 0.001 | 0.0045 | 0.0036 | 0.0002 | 0.0032 | 0.123 |
| E | 0.041 | 0.954 | 0.001 | 0.007 | 0.001 | 0.0045 | 0.0036 | 0.0002 | 0.0032 | 0.123 |
| F | 0.041 | 0.954 | 6.900 | 0.007 | 0.001 | 0.0045 | 0.0038 | 0.0002 | 0.0032 | 0.123 |
| G | 0.040 | 0.854 | 1.250 | 0.500 | 0.001 | 0.0450 | 0.0036 | 0.0002 | 0.0032 | 0.123 |
| H | 0.041 | 0.954 | 1.250 | 0.007 | 0.080 | 0.0050 | 0.0036 | 0.0002 | 0.0032 | 0.123 |
| I | 0.038 | 0.954 | 1.250 | 0.007 | 0.001 | 0.0005 | 0.0038 | 0.0002 | 0.0032 | 0.123 |
| J | 0.041 | 0.854 | 1.250 | 0.007 | 0.001 | 0.1000 | 0.0038 | 0.0002 | 0.0032 | 0.123 |
| K | 0.042 | 0.854 | 1.250 | 0.007 | 0.001 | 0.0045 | 0.0800 | 0.0002 | 0.0032 | 0.123 |
| L | 0.041 | 0.954 | 1.250 | 0.007 | 0.001 | 0.0045 | 0.0036 | 0.0002 | 0.1400 | 0.123 |
| M | 0.042 | 0.854 | 1.250 | 0.007 | 0.001 | 0.0045 | 0.0036 | 0.0002 | 0.0032 | 0.001 |
| N | 0.041 | 0.854 | 1.250 | 0.007 | 0.001 | 0.0045 | 0.0036 | 0.0002 | 0.0032 | 0.123 |
| O | 0.039 | 0.854 | 1.250 | 0.007 | 0.001 | 0.0045 | 0.0036 | 0.0002 | 0.0032 | 0.123 |
| P | 0.038 | 0.954 | 1.250 | 0.007 | 0.001 | 0.0045 | 0.0036 | 0.0001 | 0.0032 | 0.123 |
| Q | 0.041 | 0.854 | 1.250 | 0.007 | 0.001 | 0.0045 | 0.0036 | 0.0002 | 0.0032 | 0.123 |
| R | 0.085 | 0.854 | 1.250 | 0.007 | 0.001 | 0.0045 | 0.0036 | 0.0002 | 0.0032 | 0.123 |
| S | 0.065 | 0.954 | 1.250 | 0.007 | 0.001 | 0.0045 | 0.0036 | 0.0002 | 0.0032 | 0.123 |
| T | 0.025 | 0.954 | 1.250 | 0.007 | 0.001 | 0.0045 | 0.0036 | 0.0002 | 0.0032 | 0.123 |
| U | 0.039 | 1.500 | 1.250 | 0.007 | 0.001 | 0.0045 | 0.0036 | 0.0002 | 0.0032 | 0.123 |
| V | 0.040 | 0.800 | 1.250 | 0.007 | 0.001 | 0.0045 | 0.0036 | 0.0002 | 0.0032 | 0.123 |
| W | 0.041 | 0.050 | 1.250 | 0.007 | 0.001 | 0.0045 | 0.0036 | 0.0002 | 0.0032 | 0.123 |
| X | 0.038 | 0.854 | 2.300 | 0.007 | 0.001 | 0.0045 | 0.0036 | 0.0002 | 0.0032 | 0.123 |
| Y | 0.039 | 0.854 | 1.000 | 0.007 | 0.001 | 0.0045 | 0.0036 | 0.0002 | 0.0032 | 0.123 |
| Z | 0.041 | 0.954 | 0.700 | 0.007 | 0.001 | 0.0045 | 0.0036 | 0.0002 | 0.0032 | 0.123 |
| AA | 0.041 | 0.854 | 1.250 | 0.080 | 0.001 | 0.0045 | — | — | — | — |
| BB | 0.040 | 0.854 | 1.250 | 0.008 | 0.001 | 0.0045 | 0.0036 | — | 0.0032 | — |
| CC | 0.041 | 0.954 | 1.250 | 0.004 | 0.001 | 0.0045 | 0.0036 | — | 0.0032 | — |
| DD | 0.038 | 0.854 | 1.250 | 0.007 | 0.010 | 0.0045 | 0.0036 | 0.0002 | 0.0032 | 0.123 |
| EE | 0.042 | 0.854 | 1.250 | 0.007 | 0.002 | 0.0045 | 0.0036 | 0.0002 | 0.0032 | 0.123 |

| STEEL SYMBOL | Nb | Mo | Cu | Ni | V | Cr | Ca | REM | T3 (° C.) |
|---|---|---|---|---|---|---|---|---|---|
| A | 0.036 | 0.005 | — | — | — | — | 0.0010 | — | 708 |
| B | 0.037 | 0.040 | — | — | — | — | 0.0008 | — | 711 |
| C | 0.037 | 0.040 | — | — | — | — | 0.0008 | — | 657 |
| D | 0.036 | 0.005 | — | — | — | — | 0.0010 | — | 706 |
| E | 0.036 | 0.005 | — | — | — | — | 0.0010 | — | 818 |
| F | 0.036 | 0.005 | — | — | — | — | 0.0010 | — | 188 |
| G | 0.036 | 0.005 | — | — | — | — | 0.0010 | — | 706 |
| H | 0.036 | 0.005 | — | — | — | — | 0.0010 | — | 706 |
| I | 0.036 | 0.005 | — | — | — | — | 0.0010 | — | 707 |
| J | 0.036 | 0.005 | — | — | — | — | 0.0010 | — | 706 |
| K | 0.036 | 0.005 | — | — | — | — | 0.0010 | — | 706 |
| L | 0.036 | 0.005 | — | — | — | — | 0.0010 | — | 708 |
| M | 0.036 | 0.005 | — | — | — | — | 0.0010 | — | 706 |
| N | 0.001 | 0.005 | — | — | — | — | 0.0010 | — | 706 |
| O | 0.036 | 0.0001 | — | — | — | — | 0.0010 | — | 707 |
| P | 0.036 | 0.005 | — | — | — | — | 0.0010 | — | 707 |
| Q | 0.036 | 0.005 | — | — | — | — | 0.0001 | — | 706 |
| R | 0.036 | 0.005 | — | — | — | — | 0.0010 | — | 694 |
| S | 0.036 | 0.005 | — | — | — | — | 0.0010 | — | 700 |
| T | 0.036 | 0.005 | — | — | — | — | 0.0010 | — | 710 |
| U | 0.036 | 0.005 | — | — | — | — | 0.0010 | — | 707 |
| V | 0.036 | 0.005 | — | — | — | — | 0.0010 | — | 706 |
| W | 0.036 | 0.005 | — | — | — | — | 0.0010 | — | 706 |
| X | 0.036 | 0.005 | — | — | — | — | 0.0010 | — | 612 |
| Y | 0.036 | 0.005 | — | — | — | — | 0.0010 | — | 728 |
| Z | 0.036 | 0.005 | — | — | — | — | 0.0010 | — | 812 |
| AA | — | — | — | — | — | — | — | — | 706 |
| BB | — | — | — | — | — | — | — | — | 707 |
| CC | — | — | — | — | — | — | 0.0010 | — | 706 |
| DD | 0.036 | 0.005 | — | — | — | — | — | — | 707 |
| EE | 0.036 | 0.005 | — | — | — | — | 0.0010 | 0.0010 | 706 |

TABLE 2

| STEEL SYMBOL | C | Si | Mn | P | S | Al | N | B | O | Ti |
|---|---|---|---|---|---|---|---|---|---|---|
| FF | 0.041 | 0.854 | 1.250 | 0.007 | 0.001 | 0.0045 | 0.0036 | 0.0002 | 0.0032 | 0.123 |
| GG | 0.041 | 0.954 | 1.250 | 0.007 | 0.001 | 0.0045 | 0.0100 | 0.0002 | 0.0032 | 0.123 |
| HH | 0.039 | 0.854 | 1.250 | 0.007 | 0.001 | 0.0045 | 0.0040 | 0.0002 | 0.0032 | 0.123 |
| II | 0.040 | 0.954 | 1.250 | 0.007 | 0.001 | 0.0045 | 0.0010 | 0.0002 | 0.0032 | 0.123 |
| JJ | 0.041 | 0.854 | 1.250 | 0.007 | 0.001 | 0.0045 | 0.0036 | 0.0002 | 0.0100 | 0.123 |
| KK | 0.039 | 0.954 | 1.250 | 0.007 | 0.001 | 0.0045 | 0.0036 | 0.0002 | 0.0040 | 0.123 |
| LL | 0.039 | 0.854 | 1.250 | 0.500 | 0.001 | 0.0045 | 0.0036 | 0.0002 | 0.0020 | 0.123 |

TABLE 2-continued

| | | | | | | | | | | |
|---|---|---|---|---|---|---|---|---|---|---|
| MM | 0.041 | 0.854 | 1.250 | 0.007 | 0.001 | 0.0080 | 0.0036 | 0.0002 | 0.0032 | 0.123 |
| NN | 0.041 | 0.954 | 1.250 | 0.007 | 0.001 | 0.0050 | 0.0036 | 0.0002 | 0.0032 | 0.123 |
| OO | 0.040 | 0.854 | 1.250 | 0.007 | 0.001 | 0.0020 | 0.0036 | 0.0002 | 0.0032 | 0.123 |
| PP | 0.041 | 0.954 | 1.250 | 0.007 | 0.001 | 0.0045 | 0.0036 | 0.0002 | 0.0032 | 0.144 |
| QQ | 0.390 | 0.854 | 1.250 | 0.007 | 0.001 | 0.0045 | 0.0036 | 0.0002 | 0.0032 | 0.110 |
| RR | 0.041 | 0.954 | 1.250 | 0.007 | 0.001 | 0.0045 | 0.0036 | 0.0002 | 0.0032 | 0.150 |
| SS | 0.041 | 0.854 | 1.250 | 0.007 | 0.001 | 0.0045 | 0.0036 | 0.0002 | 0.0032 | 0.123 |
| TT | 0.040 | 0.854 | 1.250 | 0.007 | 0.001 | 0.0045 | 0.0036 | 0.0002 | 0.0032 | 0.123 |
| UU | 0.041 | 0.954 | 1.250 | 0.007 | 0.001 | 0.0045 | 0.0036 | 0.0002 | 0.0032 | 0.123 |
| VV | 0.039 | 0.854 | 1.250 | 0.007 | 0.001 | 0.0045 | 0.0036 | 0.0002 | 0.0032 | 0.123 |
| WW | 0.041 | 0.854 | 1.250 | 0.007 | 0.001 | 0.0045 | 0.0036 | 0.0002 | 0.0032 | 0.123 |
| XX | 0.042 | 0.954 | 1.250 | 0.007 | 0.001 | 0.0045 | 0.0036 | 0.0002 | 0.0032 | 0.123 |
| YY | 0.041 | 0.854 | 1.250 | 0.007 | 0.001 | 0.0045 | 0.0036 | 0.0002 | 0.0032 | 0.123 |
| ZZ | 0.042 | 0.954 | 1.250 | 0.007 | 0.001 | 0.0045 | 0.0036 | 0.0002 | 0.0032 | 0.123 |
| AAA | 0.040 | 0.854 | 1.250 | 0.007 | 0.001 | 0.0045 | 0.0036 | 0.0002 | 0.0032 | 0.123 |
| BBB | 0.039 | 0.954 | 1.250 | 0.007 | 0.001 | 0.0045 | 0.0036 | 0.0002 | 0.0032 | 0.123 |
| CCC | 0.038 | 0.854 | 1.250 | 0.007 | 0.001 | 0.0045 | 0.0036 | 0.0002 | 0.0032 | 0.123 |
| DDD | 0.041 | 0.954 | 1.250 | 0.007 | 0.001 | 0.0045 | 0.0036 | 0.0002 | 0.0032 | 0.123 |
| EEE | 0.041 | 0.854 | 1.250 | 0.007 | 0.001 | 0.0045 | 0.0036 | 0.0060 | 0.0032 | 0.123 |
| FFF | 0.041 | 0.954 | 1.250 | 0.080 | 0.001 | 0.0045 | 0.0036 | 0.0003 | 0.0032 | 0.123 |
| GGG | 0.038 | 0.954 | 1.250 | 0.008 | 0.001 | 0.0045 | 0.0036 | 0.0001 | 0.0032 | 0.123 |
| HHH | 0.041 | 0.854 | 1.250 | 0.004 | 0.001 | 0.0045 | 0.0036 | 0.0002 | 0.0032 | 0.123 |
| III | 0.041 | 0.954 | 1.250 | 0.007 | 0.001 | 0.0045 | 0.0036 | 0.0002 | 0.0032 | 0.123 |
| JJJ | 0.040 | 0.854 | 1.250 | 0.007 | 0.001 | 0.0045 | 0.0036 | 0.0002 | 0.0032 | 0.123 |
| KKK | 0.041 | 0.954 | 1.250 | 0.007 | 0.001 | 0.0045 | 0.0036 | 0.0002 | 0.0032 | 0.123 |
| LLL | 0.038 | 0.854 | 1.250 | 0.007 | 0.001 | 0.0045 | 0.0036 | 0.0002 | 0.0032 | 0.123 |
| MMM | 0.041 | 0.954 | 1.250 | 0.007 | 0.001 | 0.0045 | 0.0036 | 0.0002 | 0.0032 | 0.123 |

| STEEL SYMBOL | Nb | Mo | Cu | Ni | V | Cr | Ca | REM | T3 (° C.) |
|---|---|---|---|---|---|---|---|---|---|
| FF | 0.036 | 0.005 | — | — | — | — | 0.0010 | — | 706 |
| GG | 0.036 | 0.005 | — | — | — | — | 0.0010 | — | 708 |
| HH | 0.036 | 0.005 | — | — | — | — | 0.0010 | — | 707 |
| II | 0.036 | 0.005 | — | — | — | — | 0.0010 | — | 708 |
| JJ | 0.036 | 0.005 | — | — | — | — | 0.0010 | — | 706 |
| KK | 0.036 | 0.005 | — | — | — | — | 0.0010 | — | 707 |
| LL | 0.036 | 0.005 | — | — | — | — | 0.0010 | — | 707 |
| MM | 0.036 | 0.005 | — | — | — | — | 0.0010 | — | 708 |
| NN | 0.036 | 0.005 | — | — | — | — | 0.0010 | — | 706 |
| OO | 0.036 | 0.005 | — | — | — | — | 0.0010 | — | 708 |
| PP | 0.036 | 0.005 | — | — | — | — | 0.0010 | — | 706 |
| QQ | 0.036 | 0.005 | — | — | — | — | 0.0010 | — | 707 |
| RR | 0.036 | 0.005 | — | — | — | — | 0.0010 | — | 706 |
| SS | 0.144 | 0.005 | — | — | — | — | 0.0010 | — | 708 |
| TT | 0.108 | 0.005 | — | — | — | — | 0.0010 | — | 706 |
| UU | 0.054 | 0.005 | — | — | — | — | 0.0010 | — | 708 |
| VV | 0.036 | 0.139 | — | — | — | — | 0.0010 | — | 695 |
| WW | 0.036 | 0.106 | — | — | — | — | 0.0010 | — | 698 |
| XX | 0.036 | 0.048 | — | — | — | — | 0.0010 | — | 702 |
| YY | 0.036 | 0.005 | — | — | 0.145 | — | 0.0010 | — | 706 |
| ZZ | 0.036 | 0.005 | — | — | 0.105 | — | 0.0010 | — | 706 |
| AAA | 0.036 | 0.005 | — | — | 0.045 | — | 0.0010 | — | 706 |
| BBB | 0.036 | 0.005 | — | — | — | 0.143 | 0.0010 | — | 687 |
| CCC | 0.036 | 0.005 | — | — | — | 0.102 | 0.0010 | — | 700 |
| DDD | 0.036 | 0.005 | — | — | — | 0.034 | 0.0010 | — | 704 |
| EEE | 0.036 | 0.005 | — | — | — | — | 0.0010 | — | 706 |
| FFF | 0.036 | 0.005 | — | — | — | — | 0.0010 | — | 708 |
| GGG | 0.036 | 0.005 | — | — | — | — | 0.0010 | — | 707 |
| HHH | 0.036 | 0.005 | 0.800 | — | — | — | 0.0010 | — | 706 |
| III | 0.036 | 0.005 | 0.080 | — | — | — | 0.0010 | — | 708 |
| JJJ | 0.036 | 0.005 | 0.040 | — | — | — | 0.0010 | — | 706 |
| KKK | 0.036 | 0.005 | — | 0.350 | — | — | 0.0010 | — | 693 |
| LLL | 0.036 | 0.005 | — | 0.080 | — | — | 0.0010 | — | 703 |
| MMM | 0.036 | 0.005 | — | 0.020 | — | — | 0.0010 | — | 705 |

TABLE 3

| SAMPLE No. | STEEL SYMBOL | AREA RATIO OF FERRITE (%) | AREA RATIO OF BAINITE (%) | AREA RATIO OF MARTENSITE (%) | AREA RATIO OF PEARITE (%) | AREA RATIO OF RETAINED AUSTENITE (%) | TOTAL AREA RATIO OF MARTENSITE, PEARITE AND RETAINED AUSTENITE (%) | TS (MPa) | EL (%) | λ (%) | TS × λ (MPa · %) | EL × λ (% · %) | PLATING LAYER |
|---|---|---|---|---|---|---|---|---|---|---|---|---|---|
| 1 | A | 32 | 66.6 | 0.10 | 1.00 | 0.10 | 1.20 | 810.00 | 18 | 85 | 68850 | 1530 | WITHOUT |
| 2 | A | 20 | 78.9 | 0.10 | 0.90 | 0.10 | 1.10 | 811.00 | 17 | 101 | 81911 | 1717 | WITHOUT |
| 3 | A | 48 | 50.9 | 0.10 | 1.10 | 0.10 | 1.30 | 815.00 | 18 | 85 | 69275 | 1530 | WITHOUT |
| 4 | A | 39 | 59.9 | 0.10 | 0.90 | 0.10 | 1.10 | 798.00 | 19 | 81 | 64638 | 1539 | WITHOUT |
| 5 | A | 21 | 77.8 | 0.10 | 1.00 | 0.10 | 1.20 | 799.00 | 16 | 102 | 81498 | 1632 | WITHOUT |
| 6 | A | 48 | 50.6 | 0.10 | 1.10 | 0.10 | 1.30 | 810.00 | 18 | 84 | 68040 | 1512 | WITHOUT |
| 7 | A | 39 | 60.0 | 0.10 | 0.90 | 0.10 | 1.10 | 811.00 | 19 | 81 | 65691 | 1539 | WITHOUT |
| 8 | A | 39 | 60.1 | 0.10 | 1.00 | 0.10 | 1.20 | 809.00 | 18 | 82 | 66338 | 1476 | WITHOUT |
| 9 | A | 32 | 66.7 | 0.10 | 1.00 | 0.10 | 1.20 | 804.00 | 18 | 86 | 69144 | 1548 | WITHOUT |
| 10 | A | 21 | 77.6 | 0.10 | 0.90 | 0.10 | 1.10 | 812.00 | 16 | 102 | 82824 | 1632 | WITHOUT |
| 11 | A | 21 | 77.7 | 0.10 | 1.10 | 0.10 | 1.30 | 805.00 | 16 | 103 | 82915 | 1648 | WITHOUT |
| 12 | A | 32 | 66.8 | 0.10 | 1.10 | 0.10 | 1.30 | 800.00 | 18 | 87 | 69600 | 1566 | WITHOUT |
| 13 | A | 39 | 60.1 | 0.10 | 1.00 | 0.10 | 1.20 | 801.00 | 19 | 82 | 65682 | 1558 | WITHOUT |
| 14 | A | 39 | 60.2 | 0.10 | 1.10 | 0.10 | 1.30 | 809.00 | 19 | 81 | 65529 | 1539 | WITHOUT |
| 15 | A | 21 | 77.7 | 0.10 | 1.00 | 0.10 | 1.20 | 799.00 | 18 | 85 | 67915 | 1530 | WITHOUT |
| 16 | A | 21 | 78.0 | 0.10 | 0.90 | 0.10 | 1.10 | 794.00 | 16 | 101 | 80194 | 1616 | WITHOUT |
| 17 | A | 29 | 69.9 | 0.10 | 1.00 | 0.10 | 1.20 | 798.00 | 19 | 81 | 64638 | 1539 | WITHOUT |
| 18 | A | 32 | 66.8 | 0.10 | 0.90 | 0.10 | 1.10 | 810.00 | 18 | 85 | 68850 | 1530 | WITHOUT |
| 19 | A | 21 | 77.9 | 0.10 | 1.00 | 0.10 | 1.20 | 811.00 | 16 | 101 | 81911 | 1616 | WITHOUT |
| 20 | A | 21 | 77.8 | 0.10 | 1.00 | 0.10 | 1.20 | 811.00 | 16 | 102 | 82722 | 1632 | WITHOUT |
| 21 | A | 32 | 66.5 | 0.10 | 1.10 | 0.10 | 1.30 | 812.00 | 18 | 85 | 69020 | 1530 | WITHOUT |
| 22 | A | 39 | 59.8 | 0.10 | 1.10 | 0.10 | 1.30 | 810.00 | 19 | 81 | 65610 | 1539 | WITHOUT |
| 23 | A | 39 | 59.8 | 0.10 | 1.00 | 0.10 | 1.20 | 810.00 | 19 | 82 | 66420 | 1558 | WITHOUT |
| 24 | A | 32 | 66.9 | 0.10 | 0.90 | 0.10 | 1.10 | 809.00 | 18 | 85 | 68765 | 1530 | WITHOUT |
| 25 | A | 21 | 77.8 | 0.10 | 0.90 | 0.10 | 1.10 | 806.00 | 16 | 100 | 80600 | 1600 | WITHOUT |
| 26 | A | 32 | 63.6 | 3.20 | 1.00 | 0.10 | 4.30 | 830.00 | 18 | 80 | 66400 | 1440 | WITHOUT |
| 27 | A | 32 | 66.7 | 0.10 | 1.10 | 0.10 | 1.30 | 812.00 | 18 | 84 | 68208 | 1512 | WITHOUT |
| 28 | A | 32 | 66.4 | 0.10 | 1.10 | 0.10 | 1.30 | 810.00 | 18 | 85 | 68850 | 1530 | WITHOUT |
| 29 | A | 32 | 66.4 | 0.10 | 1.00 | 0.10 | 1.20 | 810.00 | 18 | 86 | 69660 | 1548 | WITH |
| 30 | A | 4 | 94.8 | 0.10 | 0.90 | 0.10 | 1.10 | 809.00 | 12 | 65 | 52585 | 780 | WITHOUT |
| 31 | A | 71 | 27.9 | 0.10 | 0.90 | 0.10 | 1.10 | 775.00 | 20 | 45 | 34875 | 900 | WITHOUT |
| 32 | A | 71 | 28.0 | 0.10 | 1.00 | 0.10 | 1.20 | 769.00 | 20 | 46 | 35374 | 920 | WITHOUT |
| 33 | A | 4 | 94.7 | 0.10 | 0.90 | 0.10 | 1.10 | 841.00 | 12 | 65 | 54665 | 780 | WITHOUT |
| 34 | A | 4 | 94.6 | 0.10 | 1.10 | 0.10 | 1.30 | 838.00 | 12 | 66 | 55308 | 792 | WITHOUT |
| 35 | A | 4 | 94.4 | 0.10 | 1.10 | 0.10 | 1.30 | 840.00 | 12 | 65 | 54600 | 780 | WITHOUT |
| 36 | A | 4 | 94.9 | 0.10 | 1.00 | 0.10 | 1.20 | 839.00 | 12 | 66 | 55374 | 792 | WITHOUT |
| 37 | A | 4 | 94.6 | 0.10 | 1.00 | 0.10 | 1.20 | 840.00 | 12 | 65 | 54600 | 780 | WITHOUT |
| 38 | A | 71 | 27.7 | 0.10 | 0.90 | 0.10 | 1.10 | 771.00 | 20 | 45 | 34695 | 900 | WITHOUT |
| 39 | A | 71 | 27.6 | 0.10 | 0.90 | 0.10 | 1.10 | 772.00 | 20 | 44 | 33968 | 880 | WITHOUT |

TABLE 4

| SAMPLE No. | STEEL SYMBOL | AREA RATIO OF FERRITE (%) | AREA RATIO OF BAINITE (%) | AREA RATIO OF MARTENSITE (%) | AREA RATIO OF PEARITE (%) | AREA RATIO OF RETAINED AUSTENITE (%) | TOTAL AREA RATIO OF MARTENSITE, PEARITE AND RETAINED AUSTENITE (%) | TS (MPa) | EL (%) | λ (%) | TS × λ (MPa · %) | EL × λ (% · %) | PLATING LAYER |
|---|---|---|---|---|---|---|---|---|---|---|---|---|---|
| 40 | A | 71 | 27.9 | 0.10 | 1.00 | 0.10 | 1.20 | 768.00 | 20 | 45 | 34560 | 900 | WITHOUT |
| 41 | A | 71 | 27.9 | 0.10 | 1.00 | 0.10 | 1.20 | 770.00 | 20 | 44 | 33880 | 880 | WITHOUT |
| 42 | A | 71 | 27.7 | 0.10 | 0.90 | 0.10 | 1.10 | 771.00 | 20 | 45 | 34695 | 900 | WITHOUT |
| 43 | A | 4 | 94.7 | 0.10 | 1.10 | 0.10 | 1.30 | 838.00 | 12 | 65 | 54470 | 780 | WITHOUT |
| 44 | A | 71 | 27.7 | 0.10 | 1.00 | 0.10 | 1.20 | 771.00 | 20 | 43 | 33153 | 860 | WITHOUT |
| 45 | A | 4 | 94.8 | 0.10 | 0.90 | 0.10 | 1.10 | 839.00 | 12 | 64 | 53696 | 768 | WITHOUT |
| 46 | A | 32 | 36.6 | 0.10 | 31.10 | 0.10 | 31.30 | 768.00 | 18 | 45 | 34560 | 810 | WITHOUT |
| 47 | A | 30 | 41.2 | 0.10 | 28.90 | 0.10 | 29.10 | 770.00 | 18 | 45 | 34560 | 810 | WITHOUT |
| 48 | A | 32 | 36.2 | 0.10 | 31.50 | 0.10 | 31.70 | 768.00 | 18 | 45 | 34560 | 810 | WITHOUT |
| 49 | A | 71 | 27.8 | 0.10 | 1.10 | 0.10 | 1.30 | 770.00 | 20 | 44 | 33880 | 880 | WITHOUT |
| 50 | A | 32 | 39.6 | 27.20 | 1.00 | 0.10 | 28.30 | 838.00 | 12 | 55 | 46090 | 660 | WITHOUT |

TABLE 4-continued

| SAMPLE No. | STEEL SYMBOL | AREA RATIO OF FERRITE (%) | AREA RATIO OF BAINITE (%) | AREA RATIO OF MARTENSITE (%) | AREA RATIO OF PEARITE (%) | AREA RATIO OF RETAINED AUSTENITE (%) | TOTAL AREA RATIO OF MARTENSITE, PEARITE AND RETAINED AUSTENITE (%) | TS (MPa) | EL (%) | λ (%) | TS × λ (MPa · %) | EL × λ (% · %) | PLATING LAYER |
|---|---|---|---|---|---|---|---|---|---|---|---|---|---|
| 51 | A | 32 | 37.0 | 0.10 | 30.90 | 0.10 | 31.10 | 773.00 | 18 | 45 | 34785 | 810 | WITHOUT |
| 52 | A | 32 | 40.2 | 26.90 | 1.00 | 0.10 | 28.00 | 837.00 | 12 | 56 | 46872 | 672 | WITHOUT |
| 53 | A | 32 | 43.6 | 20.90 | 0.90 | 2.90 | 24.70 | 773.00 | 18 | 44 | 34012 | 792 | WITHOUT |
| 54 | A | 32 | 36.4 | 0.10 | 31.40 | 0.10 | 31.60 | 771.00 | 18 | 46 | 35466 | 828 | WITHOUT |
| 55 | A | 32 | 39.8 | 27.00 | 1.00 | 0.10 | 28.10 | 837.00 | 12 | 57 | 47709 | 684 | WITHOUT |
| 56 | B | 32 | 66.4 | 0.10 | 1.00 | 0.10 | 1.20 | 342.00 | 18 | 45 | 15390 | 810 | WITHOUT |
| 57 | C | 32 | 40.0 | 27.00 | 1.00 | 0.10 | 28.10 | 840.00 | 12 | 57 | 47880 | 684 | WITHOUT |
| 58 | D | 32 | 37.0 | 0.10 | 31.00 | 0.11 | 31.21 | 772.00 | 18 | 44 | 33968 | 792 | WITHOUT |
| 59 | E | 32 | 67.0 | 0.10 | 1.00 | 0.10 | 1.20 | 341.00 | 18 | 45 | 15345 | 810 | WITHOUT |
| 60 | F | | | | | | | | | | | | |
| 61 | G | 32 | 66.7 | 0.10 | 1.00 | 0.10 | 1.20 | 851.00 | 11 | 37 | 31487 | 407 | WITHOUT |
| 62 | H | 32 | 67.0 | 0.10 | 0.90 | 0.10 | 1.10 | 811.00 | 18 | 29 | 23519 | 522 | WITHOUT |
| 63 | I | 32 | 67.1 | 0.10 | 0.90 | 0.10 | 1.10 | 810.00 | 6 | 85 | 68850 | 510 | WITHOUT |
| 64 | J | 32 | 67.1 | 0.10 | 1.00 | 0.10 | 1.20 | 809.00 | 6 | 86 | 69574 | 516 | WITHOUT |
| 65 | K | 32 | 66.7 | 0.10 | 1.10 | 0.10 | 1.30 | 851.00 | 18 | 14 | 11914 | 252 | WITHOUT |
| 66 | L | 32 | 66.6 | 0.10 | 1.10 | 0.10 | 1.30 | 811.00 | 18 | 15 | 12165 | 270 | WITHOUT |
| 67 | M | 32 | 66.4 | 0.10 | 1.00 | 0.10 | 1.20 | 346.00 | 18 | 45 | 15570 | 810 | WITHOUT |
| 68 | N | 32 | 67.0 | 0.10 | 0.90 | 0.10 | 1.10 | 346.00 | 18 | 46 | 15916 | 828 | WITHOUT |
| 69 | O | 32 | 67.0 | 0.10 | 0.90 | 0.10 | 1.10 | 341.00 | 18 | 45 | 15345 | 810 | WITHOUT |
| 70 | P | 32 | 67.0 | 0.10 | 1.00 | 0.10 | 1.20 | 342.00 | 18 | 46 | 15732 | 828 | WITHOUT |
| 71 | Q | 32 | 66.8 | 0.10 | 0.90 | 0.10 | 1.10 | 811.00 | 18 | 21 | 17031 | 378 | WITHOUT |
| 72 | R | 20 | 78.8 | 0.10 | 1.10 | 0.10 | 1.30 | 1030.00 | 28 | 75 | 77250 | 2100 | WITHOUT |
| 73 | S | 35 | 63.9 | 0.10 | 1.10 | 0.10 | 1.30 | 820.00 | 18 | 85 | 69700 | 1530 | WITHOUT |
| 74 | T | 45 | 53.8 | 0.10 | 1.00 | 0.10 | 1.20 | 610.00 | 18 | 120 | 73200 | 2160 | WITHOUT |
| 75 | U | 32 | 66.7 | 0.10 | 1.00 | 0.10 | 1.20 | 851.00 | 18 | 85 | 72335 | 1530 | WITHOUT |
| 76 | V | 32 | 67.0 | 0.10 | 0.90 | 0.10 | 1.10 | 830.00 | 18 | 86 | 71380 | 1548 | WITHOUT |
| 77 | W | 32 | 67.1 | 0.10 | 0.90 | 0.10 | 1.10 | 790.00 | 18 | 86 | 67940 | 1548 | WITHOUT |
| 78 | X | 32 | 67.1 | 0.10 | 1.00 | 0.10 | 1.20 | 852.00 | 18 | 85 | 72420 | 1530 | WITHOUT |

TABLE 5

| SAMPLE No. | STEEL SYMBOL | AREA RATIO OF FERRITE (%) | AREA RATIO OF BAINITE (%) | AREA RATIO OF MARTENSITE (%) | AREA RATIO OF PEARITE (%) | AREA RATIO OF RETAINED AUSTENITE (%) | TOTAL AREA RATIO OF MARTENSITE, PEARITE AND RETAINED AUSTENITE (%) | TS (MPa) | EL (%) | λ (%) | TS × λ (MPa · %) | EL × λ (% · %) | PLATING LAYER |
|---|---|---|---|---|---|---|---|---|---|---|---|---|---|
| 79 | Y | 32 | 66.8 | 0.10 | 1.00 | 0.10 | 1.20 | 830.00 | 18 | 86 | 71380 | 1548 | WITHOUT |
| 80 | Z | 32 | 66.8 | 0.10 | 0.90 | 0.10 | 1.10 | 792.00 | 18 | 85 | 67320 | 1530 | WITHOUT |
| 81 | AA | 32 | 66.3 | 0.10 | 1.10 | 0.10 | 1.30 | 813.00 | 18 | 85 | 69105 | 1530 | WITHOUT |
| 82 | BB | 32 | 66.9 | 0.10 | 1.00 | 0.10 | 1.20 | 810.00 | 19 | 96 | 77760 | 1824 | WITHOUT |
| 83 | CC | 32 | 67.0 | 0.10 | 0.90 | 0.10 | 1.10 | 815.00 | 21 | 101 | 82315 | 2121 | WITHOUT |
| 84 | DD | 32 | 67.0 | 0.10 | 1.00 | 0.10 | 1.20 | 806.00 | 18 | 85 | 68510 | 1530 | WITHOUT |
| 85 | EE | 32 | 66.6 | 0.10 | 1.00 | 0.10 | 1.20 | 802.00 | 19 | 95 | 76190 | 1805 | WITHOUT |
| 86 | FF | 32 | 67.1 | 0.10 | 0.90 | 0.10 | 1.10 | 814.00 | 21 | 100 | 81400 | 2100 | WITHOUT |
| 87 | GG | 32 | 67.1 | 0.10 | 1.00 | 0.10 | 1.20 | 815.00 | 18 | 85 | 69275 | 1530 | WITHOUT |
| 88 | HH | 32 | 66.8 | 0.10 | 1.00 | 0.10 | 1.20 | 816.00 | 19 | 95 | 77520 | 1805 | WITHOUT |
| 89 | II | 32 | 66.8 | 0.10 | 0.90 | 0.10 | 1.10 | 812.00 | 21 | 102 | 82824 | 2142 | WITHOUT |
| 90 | JJ | 32 | 66.3 | 0.10 | 1.10 | 0.10 | 1.30 | 811.00 | 18 | 85 | 68935 | 1530 | WITHOUT |
| 91 | KK | 32 | 66.8 | 0.10 | 1.10 | 0.10 | 1.30 | 812.00 | 19 | 95 | 77140 | 1805 | WITHOUT |
| 92 | LL | 32 | 66.9 | 0.10 | 1.00 | 0.10 | 1.20 | 813.00 | 21 | 102 | 82926 | 2142 | WITHOUT |
| 93 | MM | 32 | 66.5 | 0.10 | 1.10 | 0.10 | 1.30 | 813.00 | 18 | 85 | 69105 | 1530 | WITHOUT |
| 94 | NN | 32 | 66.6 | 0.10 | 1.00 | 0.10 | 1.20 | 815.00 | 19 | 95 | 77425 | 1805 | WITHOUT |
| 95 | OO | 32 | 66.8 | 0.10 | 0.90 | 0.10 | 1.10 | 809.00 | 21 | 100 | 80900 | 2100 | WITHOUT |
| 96 | PP | 32 | 66.7 | 0.10 | 1.00 | 0.10 | 1.20 | 847.00 | 18 | 85 | 71995 | 1530 | WITHOUT |
| 97 | QQ | 32 | 66.8 | 0.10 | 0.90 | 0.10 | 1.10 | 829.00 | 18 | 86 | 71294 | 1548 | WITHOUT |
| 98 | RR | 32 | 66.9 | 0.10 | 1.00 | 0.10 | 1.20 | 811.00 | 17 | 85 | 68935 | 1445 | WITHOUT |
| 99 | SS | 32 | 67.0 | 0.10 | 1.00 | 0.10 | 1.20 | 853.00 | 18 | 86 | 73358 | 1548 | WITHOUT |
| 100 | TT | 32 | 67.0 | 0.10 | 1.10 | 0.10 | 1.30 | 834.00 | 18 | 85 | 70890 | 1530 | WITHOUT |

TABLE 5-continued

| SAMPLE No. | STEEL SYMBOL | AREA RATIO OF FERRITE (%) | AREA RATIO OF BAINITE (%) | AREA RATIO OF MARTENSITE (%) | AREA RATIO OF PEARITE (%) | AREA RATIO OF RETAINED AUSTENITE (%) | TOTAL AREA RATIO OF MARTENSITE, PEARITE AND RETAINED AUSTENITE (%) | TS (MPa) | EL (%) | λ (%) | TS × λ (MPa · %) | EL × λ (% · %) | PLATING LAYER |
|---|---|---|---|---|---|---|---|---|---|---|---|---|---|
| 101 | UU | 32 | 66.7 | 0.10 | 1.10 | 0.10 | 1.30 | 814.00 | 18 | 85 | 69190 | 1530 | WITHOUT |
| 102 | VV | 32 | 66.7 | 0.10 | 1.00 | 0.10 | 1.20 | 855.00 | 17 | 86 | 73530 | 1462 | WITHOUT |
| 103 | WW | 32 | 66.5 | 0.10 | 0.90 | 0.10 | 1.10 | 828.00 | 18 | 86 | 71208 | 1548 | WITHOUT |
| 104 | XX | 32 | 67.0 | 0.10 | 0.90 | 0.10 | 1.10 | 809.00 | 17 | 86 | 69574 | 1462 | WITHOUT |
| 105 | YY | 32 | 66.9 | 0.10 | 1.00 | 0.10 | 1.20 | 842.00 | 18 | 85 | 71570 | 1530 | WITHOUT |
| 106 | ZZ | 32 | 67.0 | 0.10 | 1.00 | 0.10 | 1.20 | 825.00 | 18 | 86 | 70950 | 1548 | WITHOUT |
| 107 | AAA | 32 | 66.6 | 0.10 | 1.00 | 0.10 | 1.20 | 809.00 | 17 | 86 | 69574 | 1462 | WITHOUT |
| 108 | BBB | 32 | 67.0 | 0.10 | 1.00 | 0.10 | 1.20 | 841.00 | 18 | 86 | 72326 | 1548 | WITHOUT |
| 109 | CCC | 32 | 67.0 | 0.10 | 1.10 | 0.10 | 1.30 | 827.00 | 17 | 85 | 70295 | 1445 | WITHOUT |
| 110 | DDD | 32 | 66.8 | 0.10 | 1.00 | 0.10 | 1.20 | 809.00 | 17 | 85 | 68765 | 1445 | WITHOUT |
| 111 | EEE | 32 | 66.8 | 0.10 | 0.90 | 0.10 | 1.10 | 855.00 | 17 | 86 | 73530 | 1462 | WITHOUT |
| 112 | FFF | 32 | 66.4 | 0.10 | 1.00 | 0.10 | 1.20 | 829.00 | 18 | 86 | 71294 | 1548 | WITHOUT |
| 113 | GGG | 32 | 67.0 | 0.10 | 0.90 | 0.10 | 0.10 | 809.00 | 18 | 85 | 68765 | 1530 | WITHOUT |
| 114 | HHH | 32 | 66.9 | 0.10 | 1.00 | 0.10 | 1.20 | 851.00 | 18 | 85 | 72335 | 1530 | WITHOUT |
| 115 | III | 32 | 66.7 | 0.10 | 1.00 | 0.10 | 1.20 | 832.00 | 17 | 86 | 71552 | 1462 | WITHOUT |
| 116 | JJJ | 32 | 66.7 | 0.10 | 1.10 | 0.10 | 1.30 | 809.00 | 17 | 86 | 69574 | 1462 | WITHOUT |
| 117 | KKK | 32 | 66.5 | 0.10 | 1.10 | 0.10 | 1.30 | 841.00 | 18 | 85 | 71485 | 1530 | WITHOUT |
| 118 | LLL | 32.1 | 66.71 | 0.10 | 1.00 | 0.09 | 1.19 | 829.00 | 17 | 86 | 71294 | 1462 | WITHOUT |
| 119 | MMM | 31.8 | 67.12 | 0.09 | 0.90 | 0.09 | 1.08 | 808.00 | 18 | 86 | 69488 | 1548 | WITHOUT |

TABLE 6

| SAMPLE No. | STEEL SYMBOL | RE-HEATING TEMPERATURE (° C.) | ROUGH ROLLING: FINAL TEMPERATURE (° C.) | ROUGH ROLLING: CUMULATIVE REDUCTION (%) | FINISH ROLLING: END TEMPERATURE OF 6TH PASS (° C.) | FINISH ROLLING: REDUCTION OF 6TH PASS (%) | FINISH ROLLING: END TEMPERATURE OF 7TH PASS T1 (° C.) | FINISH ROLLING: REDUCTION OF 7TH PASS (%) | LAPSED TIME TO COOLING t1 (s) | AIR COOLING: START TEMPERATURE T2 (° C.) | AIR COOLING: TIME (s) | RIGHT SIDE IN FORMULA 1 | COOLING AFTER AIR COOLING RATE P (° C./s) | COILING TEMPERATURE (° C.) | FIRST COOLING: START TEMPERATURE (° C.) | FIRST COOLING: END TEMPERATURE (° C.) | FIRST COOLING: COOLING RATE (° C./s) | T3-300 (° C.) | SECOND COOLING: START TEMPERATURE (° C.) | SECOND COOLING: COOLING RATE (° C./s) |
|---|---|---|---|---|---|---|---|---|---|---|---|---|---|---|---|---|---|---|---|---|
| 1 | A | 1200 | 1100 | 55 | 950 | 15 | 900 | 8 | 2 | 670 | 4 | 18 | 18 | 606 | 596 | 412 | 0.10 | 406 | 391 | 0.02 |
| 2 | A | 1206 | 1105 | 54 | 1100 | 14 | 890 | 7 | 2 | 677 | 3 | 19 | 25 | 601 | 581 | 409 | 0.12 | 406 | 388 | 0.03 |
| 3 | A | 1203 | 1104 | 54 | 960 | 13 | 908 | 6 | 2 | 664 | 6 | 16 | 24 | 605 | 595 | 409 | 0.08 | 406 | 388 | 0.02 |
| 4 | A | 1201 | 1102 | 55 | 990 | 14 | 904 | 5 | 2 | 665 | 5 | 17 | 21 | 601 | 581 | 413 | 0.08 | 406 | 390 | 0.03 |
| 5 | A | 1200 | 1107 | 56 | 951 | 30 | 902 | 7 | 2 | 667 | 4 | 18 | 19 | 588 | 589 | 411 | 0.09 | 406 | 387 | 0.03 |
| 6 | A | 1206 | 1102 | 54 | 951 | 17 | 906 | 7 | 2 | 668 | 6 | 16 | 18 | 598 | 588 | 409 | 0.11 | 406 | 381 | 0.02 |
| 7 | A | 1209 | 1108 | 56 | 954 | 11 | 895 | 8 | 2 | 662 | 3 | 20 | 21 | 603 | 593 | 412 | 0.12 | 406 | 380 | 0.03 |
| 8 | A | 1203 | 1109 | 55 | 955 | 16 | 1020 | 6 | 2 | 669 | 4 | 18 | 28 | 601 | 581 | 413 | 0.09 | 406 | 387 | 0.03 |
| 9 | A | 1206 | 1107 | 55 | 951 | 15 | 910 | 6 | 2 | 671 | 5 | 17 | 19 | 588 | 588 | 412 | 0.08 | 406 | 386 | 0.02 |
| 10 | A | 1203 | 1105 | 55 | 956 | 14 | 860 | 5 | 2 | 678 | 3 | 19 | 21 | 603 | 593 | 411 | 0.12 | 406 | 384 | 0.02 |
| 11 | A | 1204 | 1103 | 55 | 957 | 15 | 880 | 9 | 2 | 675 | 6 | 16 | 17 | 605 | 595 | 410 | 0.11 | 406 | 386 | 0.02 |
| 12 | A | 1203 | 1102 | 55 | 953 | 15 | 908 | 7 | 2 | 670 | 5 | 17 | 21 | 601 | 591 | 413 | 0.10 | 406 | 388 | 0.03 |
| 13 | A | 1206 | 1105 | 54 | 954 | 14 | 905 | 4 | 2 | 671 | 4 | 18 | 18 | 600 | 590 | 408 | 0.09 | 406 | 381 | 0.03 |
| 14 | A | 1206 | 1108 | 55 | 955 | 16 | 896 | 8 | 2 | 730 | 6 | 13 | 19 | 598 | 589 | 409 | 0.08 | 406 | 381 | 0.02 |
| 15 | A | 1208 | 1102 | 56 | 957 | 13 | 887 | 6 | 2 | 660 | 3 | 20 | 21 | 588 | 588 | 410 | 0.11 | 406 | 388 | 0.03 |
| 16 | A | 1208 | 1104 | 54 | 953 | 12 | 901 | 5 | 2 | 620 | 4 | 21 | 23 | 602 | 582 | 412 | 0.10 | 406 | 391 | 0.02 |
| 17 | A | 1203 | 1102 | 53 | 951 | 15 | 904 | 7 | 2 | 664 | 8 | 14 | 28 | 601 | 591 | 409 | 0.12 | 406 | 890 | 0.03 |
| 18 | A | 1204 | 1103 | 56 | 952 | 16 | 903 | 5 | 2 | 665 | 5 | 17 | 19 | 600 | 590 | 411 | 0.09 | 406 | 381 | 0.02 |
| 19 | A | 1203 | 1106 | 57 | 953 | 15 | 896 | 6 | 2 | 667 | 2 | 23 | 25 | 606 | 596 | 410 | 0.09 | 406 | 382 | 0.03 |
| 20 | A | 1201 | 1109 | 54 | 958 | 14 | 895 | 7 | 2 | 668 | 4 | 18 | 21 | 640 | 630 | 408 | 0.08 | 406 | 383 | 0.02 |
| 21 | A | 1200 | 1102 | 55 | 946 | 13 | 906 | 6 | 2 | 662 | 6 | 16 | 23 | 580 | 580 | 413 | 0.07 | 406 | 380 | 0.03 |
| 22 | A | 1206 | 1103 | 54 | 956 | 12 | 903 | 5 | 2 | 669 | 5 | 17 | 18 | 450 | 440 | 410 | 0.09 | 406 | 387 | 0.02 |
| 23 | A | 1209 | 1102 | 57 | 950 | 14 | 902 | 8 | 2 | 671 | 7 | 15 | 21 | 601 | 591 | 409 | 0.13 | 406 | 386 | 0.02 |
| 24 | A | 1203 | 1104 | 54 | 953 | 15 | 907 | 8 | 2 | 678 | 6 | 16 | 18 | 605 | 595 | 412 | 0.09 | 406 | 390 | 0.03 |
| 25 | A | 1203 | 1105 | 53 | 952 | 16 | 901 | 8 | 2 | 675 | 4 | 18 | 19 | 601 | 591 | 412 | 0.04 | 406 | 388 | 0.03 |
| 26 | A | 1206 | 1104 | 56 | 954 | 15 | 904 | 6 | 2 | 671 | 5 | 17 | 21 | 599 | 589 | 413 | 0.08 | 406 | 387 | 0.04 |
| 27 | A | 1206 | 1108 | 57 | 851 | 14 | 906 | 7 | 2 | 679 | 6 | 16 | 19 | 598 | 588 | 412 | 0.09 | 406 | 385 | 0.02 |
| 28 | A | 1208 | 1102 | 54 | 952 | 14 | 905 | 5 | 2 | 668 | 4 | 18 | 18 | 603 | 593 | 411 | 0.11 | 406 | 384 | 0.01 |
| 29 | A | 1208 | 1103 | 56 | 954 | 13 | 904 | 8 | 2 | 665 | 5 | 17 | 19 | 601 | 591 | 410 | 0.12 | 406 | 386 | 0.03 |

TABLE 7

| SAMPLE No. | STEEL SYMBOL | RE-HEATING TEMPERATURE (° C.) | ROUGH ROLLING FINAL TEMPERATURE (° C.) | ROUGH ROLLING CUMULATIVE REDUCTION (%) | FINISH ROLLING END TEMPERATURE OF 6TH PASS (° C.) | FINISH ROLLING RE-DUCTION OF 6TH PASS (%) | FINISH ROLLING END TEMPERATURE OF 7TH PASS T1 (° C.) | FINISH ROLLING RE-DUCTION OF 7TH PASS (%) | E-LAPSED TIME TO COOLING t1 (s) | AIR COOLING START TEMPERATURE T2 (° C.) | AIR COOLING TIME (s) | RIGHT SIDE IN FORMULA 1 | COOLING AFTER AIR COOLING COOLING RATE P (° C./s) | COILING TEMPERATURE (° C.) | FIRST COOLING START TEMPERATURE (° C.) | FIRST COOLING END TEMPERATURE (° C.) | FIRST COOLING COOLING RATE (° C./s) | T3-300 (° C.) | SECOND COOLING START TEMPERATURE (° C.) | SECOND COOLING COOLING RATE (° C./s) |
|---|---|---|---|---|---|---|---|---|---|---|---|---|---|---|---|---|---|---|---|---|
| 30 | A | 1203 | 1290 | 57 | 951 | 15 | 906 | 6 | 2 | 669 | 6 | 16 | 21 | 598 | 588 | 413 | 0.09 | 406 | 384 | 0.03 |
| 31 | A | 1204 | 1220 | 54 | 950 | 16 | 908 | 7 | 2 | 661 | 4 | 19 | 20 | 603 | 593 | 408 | 0.08 | 406 | 386 | 0.02 |
| 32 | A | 1203 | 1008 | 78 | 950 | 14 | 902 | 5 | 2 | 772 | 5 | 13 | 18 | 605 | 595 | 408 | 0.12 | 406 | 381 | 0.03 |
| 33 | A | 1201 | 1107 | 31 | 954 | 15 | 901 | 6 | 2 | 670 | 6 | 16 | 21 | 601 | 591 | 410 | 0.11 | 406 | 389 | 0.03 |
| 34 | A | 1200 | 1105 | 54 | 1180 | 13 | 902 | 7 | 2 | 670 | 4 | 18 | 22 | 600 | 580 | 412 | 0.10 | 406 | 391 | 0.02 |
| 35 | A | 1203 | 1103 | 54 | 920 | 12 | 905 | 8 | 2 | 667 | 6 | 16 | 20 | 599 | 589 | 409 | 0.09 | 406 | 390 | 0.02 |
| 36 | A | 1204 | 1102 | 55 | 954 | 58 | 904 | 8 | 2 | 668 | 5 | 17 | 19 | 598 | 588 | 409 | 0.08 | 406 | 381 | 0.02 |
| 37 | A | 1203 | 1005 | 56 | 955 | 6 | 901 | 6 | 2 | 662 | 7 | 16 | 18 | 602 | 592 | 413 | 0.11 | 406 | 382 | 0.03 |
| 38 | A | 1206 | 1109 | 54 | 951 | 16 | 1080 | 7 | 2 | 669 | 6 | 15 | 17 | 601 | 591 | 411 | 0.10 | 406 | 383 | 0.03 |
| 39 | A | 1206 | 1002 | 56 | 956 | 15 | 910 | 6 | 2 | 671 | 4 | 19 | 21 | 600 | 590 | 409 | 0.10 | 406 | 390 | 0.02 |
| 40 | A | 1200 | 1104 | 55 | 958 | 14 | 905 | 15 | 2 | 678 | 5 | 16 | 18 | 606 | 596 | 412 | 0.10 | 406 | 387 | 0.03 |
| 41 | A | 1206 | 1102 | 55 | 953 | 15 | 904 | 2 | 2 | 675 | 6 | 16 | 19 | 606 | 596 | 412 | 0.10 | 406 | 386 | 0.02 |
| 42 | A | 1208 | 1103 | 55 | 954 | 15 | 906 | 6 | 2 | 810 | 5 | 17 | 21 | 606 | 596 | 413 | 0.08 | 406 | 390 | 0.03 |
| 43 | A | 1203 | 1106 | 55 | 955 | 14 | 908 | 5 | 2 | 540 | 7 | 15 | 18 | 520 | 510 | 412 | 0.12 | 406 | 388 | 0.02 |
| 44 | A | 1203 | 1108 | 55 | 957 | 16 | 902 | 7 | 2 | 668 | 18 | 12 | 19 | 606 | 596 | 411 | 0.11 | 406 | 387 | 0.03 |
| 45 | A | 1206 | 1107 | 54 | 953 | 13 | 901 | 7 | 2 | 665 | 0.4 | 37.4 | 17 | 606 | 596 | 410 | 0.10 | 406 | 391 | 0.02 |
| 46 | A | 1206 | 1105 | 55 | 951 | 12 | 906 | 8 | 2 | 669 | 6 | 16 | 6 | 606 | 596 | 412 | 0.11 | 406 | 391 | 0.03 |
| 47 | A | 1206 | 1105 | 55 | 951 | 12 | 906 | 8 | 2 | 669 | 5 | 17 | 4 | 606 | 596 | 412 | 0.11 | 406 | 391 | 0.03 |
| 48 | A | 1206 | 1105 | 55 | 951 | 12 | 906 | 8 | 2 | 669 | 6 | 16 | 2 | 606 | 596 | 412 | 0.11 | 406 | 391 | 0.03 |
| 49 | A | 1200 | 1103 | 56 | 950 | 15 | 903 | 6 | 2 | 661 | 4 | 19 | 20 | 710 | 700 | 412 | 0.12 | 406 | 391 | 0.03 |
| 50 | A | 1200 | 1102 | 54 | 951 | 16 | 902 | 6 | 2 | 670 | 5 | 17 | 18 | 310 | 300 | 397 | 0.09 | 406 | 390 | 0.02 |
| 51 | A | 1210 | 1105 | 53 | 956 | 15 | 907 | 7 | 2 | 668 | 6 | 16 | 19 | 606 | 605 | 410 | 0.08 | 406 | 388 | 0.03 |
| 52 | A | 1208 | 1103 | 56 | 957 | 14 | 901 | 5 | 2 | 685 | 4 | 18 | 21 | 606 | 596 | 474 | 0.10 | 406 | 387 | 0.02 |
| 53 | A | 1205 | 1102 | 57 | 953 | 13 | 904 | 6 | 2 | 669 | 6 | 16 | 23 | 606 | 596 | 412 | 0.50 | 406 | 391 | 0.03 |
| 54 | A | 1202 | 1106 | 54 | 954 | 12 | 906 | 7 | 2 | 661 | 5 | 17 | 28 | 606 | 596 | 412 | 0.10 | 406 | 420 | 0.03 |
| 55 | A | 1203 | 1108 | 55 | 955 | 14 | 905 | 8 | 2 | 670 | 7 | 15 | 17 | 606 | 596 | 413 | 0.10 | 406 | 391 | 0.16 |
| 56 | B | 1200 | 1102 | 54 | 957 | 15 | 904 | 8 | 2 | 670 | 6 | 5 | 18 | 611 | 601 | 412 | 0.09 | 411 | 396 | 0.02 |
| 57 | C | 1200 | 1104 | 57 | 950 | 15 | 906 | 6 | 2 | 670 | 4 | 85 | 90 | 557 | 547 | 412 | 0.08 | 357 | 342 | 0.03 |
| 58 | D | 1202 | 1105 | 54 | 955 | 13 | 908 | 7 | 2 | 670 | 4 | 18 | 21 | 606 | 596 | 412 | 0.11 | 406 | 391 | 0.02 |

TABLE 8

| SAMPLE No. | STEEL SYMBOL | RE-HEATING TEMPERATURE (° C.) | ROUGH ROLLING: FINAL TEMPERATURE (° C.) | ROUGH ROLLING: CUMULATIVE REDUCTION (%) | FINISH ROLLING: END TEMPERATURE OF 6TH PASS (° C.) | FINISH ROLLING: RE-DUCTION OF 6TH PASS (%) | FINISH ROLLING: END TEMPERATURE OF 7TH PASS T1 (° C.) | FINISH ROLLING: RE-DUCTION OF 7TH PASS (%) | E-LAPSED TIME TO COOLING t1 (s) | AIR COOLING: START TEMPERATURE T2 (° C.) | AIR COOLING: TIME (s) | RIGHT SIDE IN FORMULA 1 | COOLING AFTER AIR COOLING: COOLING RATE P (° C./s) | COILING TEMPERATURE (° C.) | FIRST COOLING: START TEMPERATURE (° C.) | FIRST COOLING: END TEMPERATURE (° C.) | FIRST COOLING: COOLING RATE (° C./s) | T3-300 (° C.) | SECOND COOLING: START TEMPERATURE (° C.) | SECOND COOLING: COOLING RATE (° C./s) |
|---|---|---|---|---|---|---|---|---|---|---|---|---|---|---|---|---|---|---|---|---|
| 30 | E | 1203 | 1102 | 53 | 950 | 12 | 900 | 6 | 2 | 673 | 5 | 17 | 18 | 685 | 675 | 525 | 0.10 | 518 | 503 | 0.03 |
| 31 | F | | | | | | | | | | | | | | | | | | | |
| 32 | G | 1200 | 1103 | 53 | 955 | 16 | 880 | 8 | 2 | 661 | 6 | 16 | 17 | 595 | 595 | 409 | 0.08 | 395 | 380 | 0.03 |
| 33 | H | 1200 | 1106 | 56 | 951 | 15 | 908 | 6 | 2 | 772 | 5 | 13 | 21 | 606 | 596 | 412 | 0.09 | 406 | 390 | 0.03 |
| 34 | I | 1210 | 1109 | 57 | 956 | 14 | 905 | 5 | 2 | 670 | 4 | 17 | 18 | 607 | 597 | 413 | 0.11 | 406 | 387 | 0.02 |
| 35 | J | 1209 | 1107 | 54 | 957 | 15 | 896 | 7 | 2 | 670 | 6 | 16 | 18 | 601 | 591 | 412 | 0.12 | 407 | 386 | 0.03 |
| 36 | K | 1205 | 1105 | 55 | 953 | 15 | 897 | 7 | 2 | 667 | 3 | 20 | 21 | 605 | 595 | 411 | 0.09 | 406 | 390 | 0.03 |
| 37 | L | 1202 | 1103 | 55 | 954 | 14 | 901 | 8 | 2 | 668 | 4 | 18 | 23 | 601 | 591 | 410 | 0.08 | 406 | 388 | 0.02 |
| 38 | M | 1203 | 1102 | 55 | 955 | 16 | 904 | 6 | 2 | 662 | 5 | 18 | 28 | 599 | 589 | 413 | 0.12 | 406 | 387 | 0.02 |
| 39 | N | 1201 | 1105 | 55 | 957 | 13 | 903 | 6 | 2 | 669 | 3 | 19 | 21 | 598 | 588 | 406 | 0.11 | 406 | 385 | 0.02 |
| 40 | O | 1202 | 1103 | 55 | 953 | 12 | 896 | 7 | 2 | 671 | 6 | 15 | 18 | 603 | 583 | 409 | 0.10 | 406 | 384 | 0.03 |
| 41 | P | 1206 | 1102 | 55 | 951 | 15 | 895 | 5 | 2 | 678 | 5 | 15 | 21 | 601 | 581 | 410 | 0.08 | 407 | 386 | 0.03 |
| 42 | Q | 1209 | 1106 | 54 | 950 | 16 | 906 | 6 | 2 | 675 | 4 | 18 | 23 | 598 | 588 | 412 | 0.08 | 407 | 384 | 0.02 |
| 43 | R | 1208 | 1109 | 54 | 951 | 15 | 903 | 7 | 2 | 671 | 6 | 31 | 34 | 603 | 593 | 409 | 0.11 | 406 | 386 | 0.03 |
| 44 | S | 1205 | 1102 | 55 | 956 | 14 | 902 | 8 | 2 | 679 | 3 | 29 | 33 | 605 | 595 | 411 | 0.10 | 394 | 381 | 0.02 |
| 45 | T | 1202 | 1104 | 56 | 957 | 13 | 907 | 8 | 2 | 668 | 4 | 12 | 18 | 601 | 591 | 410 | 0.10 | 400 | 388 | 0.03 |
| 46 | U | 1204 | 1105 | 54 | 953 | 12 | 901 | 6 | 2 | 665 | 5 | 16 | 19 | 600 | 590 | 411 | 0.10 | 410 | 395 | 0.02 |
| 47 | V | 1204 | 1102 | 56 | 954 | 14 | 904 | 7 | 2 | 668 | 6 | 16 | 21 | 599 | 589 | 413 | 0.10 | 407 | 390 | 0.03 |
| 48 | W | 1207 | 1103 | 55 | 955 | 15 | 906 | 8 | 2 | 661 | 4 | 19 | 21 | 598 | 588 | 412 | 0.08 | 406 | 381 | 0.02 |
| 49 | X | 1210 | 1102 | 55 | 957 | 16 | 905 | 6 | 2 | 670 | 6 | 15 | 18 | 602 | 592 | 409 | 0.12 | 406 | 382 | 0.03 |
| 50 | Y | 1202 | 1106 | 55 | 950 | 15 | 904 | 5 | 2 | 668 | 5 | 16 | 17 | 601 | 591 | 412 | 0.11 | 312 | 383 | 0.03 |
| 51 | Z | 1209 | 1102 | 55 | 955 | 14 | 906 | 7 | 2 | 665 | 7 | 16 | 21 | 600 | 590 | 436 | 0.10 | 429 | 390 | 0.02 |
| 52 | AA | 1204 | 1103 | 55 | 950 | 14 | 908 | 5 | 2 | 669 | 6 | 16 | 19 | 606 | 596 | 527 | 0.08 | 512 | 387 | 0.03 |
| 53 | BB | 1205 | 1102 | 54 | 957 | 13 | 902 | 6 | 2 | 661 | 4 | 18 | 21 | 606 | 596 | 412 | 0.09 | 406 | 386 | 0.02 |
| 54 | CC | 1203 | 1104 | 55 | 953 | 15 | 901 | 7 | 2 | 670 | 4 | 18 | 21 | 606 | 596 | 411 | 0.11 | 406 | 390 | 0.03 |
| 55 | DD | 1201 | 1105 | 56 | 954 | 16 | 902 | 6 | 2 | 665 | 5 | 16 | 22 | 606 | 586 | 408 | 0.12 | 406 | 388 | 0.03 |
| 56 | EE | 1207 | 1104 | 54 | 955 | 14 | 905 | 5 | 2 | 667 | 6 | 16 | 20 | 607 | 587 | 408 | 0.09 | 407 | 387 | 0.03 |
| 57 | FF | 1206 | 1108 | 53 | 957 | 15 | 904 | 8 | 2 | 668 | 4 | 18 | 19 | 605 | 595 | 410 | 0.08 | 406 | 391 | 0.02 |
| 58 | GG | 1205 | 1102 | 56 | 953 | 13 | 901 | 8 | 2 | 662 | 5 | 17 | 18 | 601 | 591 | 412 | 0.12 | 406 | 391 | 0.03 |

TABLE 9

| SAMPLE No. | STEEL SYMBOL | RE-HEATING TEMPERATURE (° C.) | ROUGH ROLLING: FINAL TEMPERATURE (° C.) | ROUGH ROLLING: CUMULATIVE REDUCTION (%) | FINISH ROLLING: END TEMPERATURE OF 6TH PASS (° C.) | FINISH ROLLING: REDUCTION OF 6TH PASS (%) | FINISH ROLLING: END TEMPERATURE OF 7TH PASS T1 (° C.) | FINISH ROLLING: REDUCTION OF 7TH PASS (%) | LAPSED TIME TO COOLING t1 (s) | AIR COOLING: START TEMPERATURE T2 (° C.) | AIR COOLING: TIME (s) | RIGHT SIDE IN FORMULA 1 | COOLING AFTER AIR COOLING RATE P (° C./s) | COILING TEMPERATURE (° C.) | FIRST COOLING: START TEMPERATURE (° C.) | FIRST COOLING: END TEMPERATURE (° C.) | FIRST COOLING: COOLING RATE (° C./s) | T3-300 (° C.) | SECOND COOLING: START TEMPERATURE (° C.) | SECOND COOLING: COOLING RATE (° C./s) |
|---|---|---|---|---|---|---|---|---|---|---|---|---|---|---|---|---|---|---|---|---|
| 88 | HH | 1204 | 1103 | 57 | 951 | 12 | 900 | 8 | 2 | 669 | 6 | 15 | 17 | 598 | 589 | 408 | 0.11 | 406 | 391 | 0.02 |
| 89 | II | 1203 | 1108 | 54 | 952 | 15 | 900 | 6 | 2 | 671 | 4 | 18 | 21 | 598 | 588 | 411 | 0.10 | 407 | 390 | 0.03 |
| 90 | JJ | 1201 | 1102 | 55 | 953 | 15 | 900 | 7 | 2 | 678 | 6 | 16 | 18 | 603 | 583 | 410 | 0.10 | 406 | 387 | 0.03 |
| 91 | KK | 1207 | 1104 | 54 | 958 | 14 | 902 | 5 | 2 | 675 | 5 | 16 | 18 | 601 | 591 | 409 | 0.09 | 406 | 386 | 0.02 |
| 92 | LL | 1206 | 1105 | 57 | 946 | 15 | 905 | 8 | 2 | 670 | 7 | 15 | 18 | 598 | 588 | 413 | 0.08 | 407 | 390 | 0.03 |
| 93 | MM | 1204 | 1102 | 54 | 956 | 15 | 904 | 6 | 2 | 671 | 6 | 16 | 18 | 603 | 593 | 408 | 0.11 | 407 | 388 | 0.02 |
| 94 | NN | 1208 | 1103 | 53 | 950 | 14 | 901 | 7 | 2 | 670 | 4 | 18 | 21 | 605 | 595 | 409 | 0.10 | 406 | 387 | 0.03 |
| 95 | OO | 1206 | 1102 | 56 | 953 | 16 | 902 | 5 | 2 | 670 | 5 | 17 | 18 | 601 | 591 | 412 | 0.10 | 406 | 391 | 0.03 |
| 96 | PP | 1203 | 1106 | 57 | 952 | 13 | 901 | 6 | 2 | 670 | 6 | 16 | 18 | 600 | 590 | 412 | 0.10 | 406 | 391 | 0.03 |
| 97 | QQ | 1201 | 1102 | 55 | 954 | 12 | 906 | 7 | 2 | 670 | 5 | 16 | 21 | 598 | 589 | 413 | 0.10 | 406 | 391 | 0.02 |
| 98 | RR | 1200 | 1103 | 55 | 951 | 15 | 903 | 8 | 2 | 661 | 7 | 16 | 22 | 598 | 588 | 412 | 0.08 | 406 | 392 | 0.03 |
| 99 | SS | 1206 | 1104 | 55 | 956 | 16 | 902 | 8 | 2 | 670 | 4 | 18 | 20 | 602 | 592 | 412 | 0.12 | 407 | 391 | 0.02 |
| 100 | TT | 1209 | 1105 | 55 | 957 | 15 | 907 | 6 | 2 | 668 | 4 | 18 | 19 | 601 | 591 | 412 | 0.11 | 406 | 391 | 0.03 |
| 101 | UU | 1203 | 1102 | 54 | 953 | 14 | 901 | 7 | 2 | 665 | 4 | 18 | 21 | 600 | 580 | 412 | 0.10 | 406 | 391 | 0.02 |
| 102 | VV | 1205 | 1103 | 57 | 954 | 15 | 904 | 8 | 2 | 669 | 5 | 16 | 17 | 585 | 585 | 412 | 0.08 | 406 | 391 | 0.03 |
| 103 | WW | 1203 | 1102 | 54 | 955 | 15 | 906 | 8 | 2 | 661 | 6 | 16 | 21 | 585 | 585 | 412 | 0.08 | 395 | 380 | 0.03 |
| 104 | XX | 1204 | 1106 | 53 | 957 | 15 | 905 | 5 | 2 | 670 | 4 | 18 | 21 | 598 | 588 | 412 | 0.11 | 398 | 383 | 0.02 |
| 105 | YY | 1203 | 1102 | 56 | 950 | 15 | 804 | 8 | 2 | 665 | 5 | 17 | 19 | 602 | 592 | 412 | 0.12 | 402 | 387 | 0.03 |
| 106 | ZZ | 1206 | 1103 | 57 | 955 | 15 | 900 | 6 | 2 | 667 | 6 | 17 | 21 | 606 | 596 | 412 | 0.08 | 406 | 391 | 0.02 |
| 107 | AAA | 1206 | 1101 | 55 | 950 | 14 | 900 | 7 | 2 | 668 | 4 | 18 | 21 | 606 | 596 | 413 | 0.08 | 406 | 391 | 0.03 |
| 108 | BBB | 1208 | 1103 | 55 | 957 | 16 | 900 | 5 | 2 | 662 | 6 | 16 | 19 | 606 | 596 | 412 | 0.12 | 406 | 391 | 0.03 |
| 109 | CCC | 1209 | 1102 | 55 | 953 | 13 | 902 | 6 | 2 | 669 | 5 | 16 | 17 | 597 | 587 | 412 | 0.10 | 387 | 392 | 0.03 |
| 110 | DDD | 1203 | 1107 | 55 | 954 | 12 | 907 | 7 | 2 | 671 | 7 | 15 | 18 | 600 | 590 | 412 | 0.10 | 400 | 385 | 0.03 |
| 111 | EEE | 1204 | 1102 | 54 | 955 | 15 | 901 | 8 | 2 | 678 | 6 | 16 | 18 | 604 | 594 | 412 | 0.10 | 404 | 389 | 0.03 |
| 112 | FFF | 1204 | 1105 | 56 | 957 | 16 | 904 | 8 | 2 | 675 | 4 | 18 | 22 | 606 | 596 | 412 | 0.10 | 406 | 391 | 0.03 |
| 113 | GGG | 1205 | 1104 | 54 | 953 | 15 | 906 | 6 | 2 | 670 | 5 | 16 | 18 | 605 | 595 | 412 | 0.08 | 406 | 391 | 0.03 |
| 114 | HHH | 1206 | 1102 | 55 | 951 | 14 | 905 | 7 | 2 | 671 | 6 | 16 | 18 | 601 | 591 | 412 | 0.12 | 407 | 387 | 0.02 |
| 115 | III | 1208 | 1107 | 57 | 952 | 15 | 904 | 8 | 2 | 670 | 5 | 17 | 20 | 598 | 589 | 413 | 0.11 | 408 | 386 | 0.03 |
| 116 | JJJ | 1209 | 1108 | 54 | 953 | 15 | 900 | 8 | 2 | 670 | 7 | 15 | 21 | 598 | 588 | 412 | 0.08 | 406 | 390 | 0.02 |
| 117 | KKK | 1202 | 1102 | 53 | 950 | 15 | 900 | 8 | 2 | 670 | 4 | 18 | 21 | 803 | 593 | 411 | 0.08 | 406 | 388 | 0.03 |
| 118 | LLL | 1204 | 1108 | 52 | 950 | 14 | 900 | 8 | 2 | 670 | 4 | 17 | 19 | 801 | 591 | 408 | 0.11 | 403 | 378 | 0.02 |
| 119 | MMM | 1201 | 1104 | 55 | 951 | 15 | 903 | 6 | 2 | 671 | 5 | 17 | 18 | 598 | 588 | 409 | 0.10 | 403 | 388 | 0.03 |

INDUSTRIAL APPLICABILITY

The present invention may be used in an industry related to a hot-rolled steel sheet used for an underbody part of an automobile, for example.

The invention claimed is:

1. A hot-rolled steel sheet comprising:

a chemical composition represented by, in mass %,

C: 0.02% to 0.15%,
Si: 0.01% to 2.0%,
Mn: 0.05% to 3.0%,
P: 0.1% or less,
S: 0.03% or less,
Al: 0.001% to 0.01%,
N: 0.02% or less,
O: 0.02% or less,
Ti: 0% to 0.2%,
Nb: 0% to 0.2%
Mo: 0% to 0.2%
V: 0% to 0.2%
Cr: 0% to 1.0%,
B: 0% to 0.01%,
Cu: 0% to 1.2%,
Ni: 0% to 0.6%,
Ca: 0% to 0.005%,
REM: 0% to 0.02%, and
the balance: Fe and an impurity; and a steel structure represented by an area ratio of ferrite: 5% to 50%,
an area ratio of bainite composed of an aggregate of bainitic ferrite whose grain average misorientation is 0.4° to 3°: 50% to 95%, and
a total area ratio of martensite, pearlite, and retained austenite: 5% or less.

2. The hot-rolled steel sheet according to claim 1, wherein the chemical composition satisfies one or more selected from the group consisting of, in mass %, Ti: 0.01% to 0.2%,
Nb: 0.01% to 0.2%,
Mo: 0.001% to 0.2%,
V: 0.01% to 0.2%,
Cr: 0.01% to 1.0%,
B: 0.0002% to 0.01%,
Cu: 0.02% to 1.2%, and
Ni: 0.01% to 0.6%.

3. The hot-rolled steel sheet according to claim 1, wherein the chemical composition satisfies one or more selected from the group consisting of, in mass %, Ca: 0.0005% to 0.005% and
REM: 0.0005% to 0.02%.

4. The hot-rolled steel sheet according to claim 2, wherein the chemical composition satisfies one or more selected from the group consisting of, in mass %, Ca: 0.0005% to 0.005% and
REM: 0.0005% to 0.02%.

* * * * *